US011415331B2

(12) United States Patent
Lee et al.

(10) Patent No.: US 11,415,331 B2
(45) Date of Patent: Aug. 16, 2022

(54) COOKWARE AND EXHAUST DEVICE

(71) Applicant: LG Electronics Inc., Seoul (KR)

(72) Inventors: Semi Lee, Seoul (KR); Sangcheol Lee, Seoul (KR); Seonghoon Hwang, Seoul (KR); Wontae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 417 days.

(21) Appl. No.: 16/465,682

(22) PCT Filed: Dec. 1, 2017

(86) PCT No.: PCT/KR2017/014036
§ 371 (c)(1),
(2) Date: May 31, 2019

(87) PCT Pub. No.: WO2018/101801
PCT Pub. Date: Jun. 7, 2018

(65) Prior Publication Data

US 2019/0277521 A1 Sep. 12, 2019

(30) Foreign Application Priority Data

Dec. 2, 2016 (KR) ..... 10-2016-0163512
Nov. 28, 2017 (KR) ..... 10-2017-0160370

(51) Int. Cl.
*F24F 7/10* (2006.01)
*F24F 7/007* (2006.01)
(Continued)

(52) U.S. Cl.
CPC ..... *F24F 7/10* (2013.01); *F24C 15/20* (2013.01); *F24C 15/2035* (2013.01);
(Continued)

(58) Field of Classification Search
CPC ..... F24F 7/10; F24F 7/06; F24F 7/007; F24F 2221/46; F24C 15/20; F24C 15/2035; F24C 15/2042; F24C 15/2028; F24C 15/2071
(Continued)

(56) References Cited

U.S. PATENT DOCUMENTS 4,089,328 A * 5/1978 Bergmark ..... F24C 15/20 126/299 D
5,395,410 A * 3/1995 Jang ..... B01D 45/14 126/299 D
(Continued)

FOREIGN PATENT DOCUMENTS

JP H11-281108 10/1999
JP 2000266385 9/2000
(Continued)

OTHER PUBLICATIONS

Extended European Search Report in European Appln. No. 17875992.4, dated Jul. 30, 2020, 10 pages.
(Continued)

*Primary Examiner* — Steven B McAllister
*Assistant Examiner* — Charles R Brawner
(74) *Attorney, Agent, or Firm* — Fish & Richardson P.C.

(57) ABSTRACT

A ventilation apparatus according to the present invention comprises: a case having a flow hole; a flow guide positioned inside the case, the flow guide having an inflow opening that communicates with the flow hole, and the flow guide having a guide surface that slopes downward as the same extends outward; a swirler positioned in an area formed by the flow guide and configured to rotate in order to discharge a part of air introduced through the flow hole out of the case again, the swirler having a plurality of blades; a driving motor for rotating the swirler; and a grill member
(Continued)

that covers the swirler outside the case and provides an air channel. The grill member comprises a grill rib that forms a suction channel for suctioning air and a discharge channel for discharging air. The discharge channel may be positioned outside the suction channel.

14 Claims, 30 Drawing Sheets

(51) Int. Cl.
*F24F 7/06* (2006.01)
*F24C 15/20* (2006.01)

(52) U.S. Cl.
CPC ..... *F24C 15/2042* (2013.01); *F24F 7/007* (2013.01); *F24F 7/06* (2013.01)

(58) Field of Classification Search
USPC ..... 454/234
See application file for complete search history.

(56) References Cited

U.S. PATENT DOCUMENTS

| | | | | |
|---|---|---|---|---|
| 6,551,185 | B1 | 4/2003 | Miyake | |
| 10,295,195 | B2 * | 5/2019 | Kim | F24C 15/2028 |
| 2004/0194778 | A1 * | 10/2004 | Yeung | F04D 29/4233 126/299 R |
| 2008/0156313 | A1 * | 7/2008 | Sohn | F24C 15/006 126/299 D |
| 2015/0059731 | A1 * | 3/2015 | Rho | F24C 15/20 126/299 D |
| 2015/0204282 | A1 * | 7/2015 | Merritt | B01D 46/0002 55/482 |
| 2016/0273779 | A1 | 9/2016 | Kim | |
| 2017/0261217 | A1 * | 9/2017 | Oh | F24F 7/065 |
| 2021/0025598 | A1 * | 1/2021 | Lee | F24C 15/2042 |

FOREIGN PATENT DOCUMENTS

| | | | | |
|---|---|---|---|---|
| KR | 10-2003-0020593 | | 3/2003 | |
| KR | 10-2007-0000787 | | 1/2007 | |
| KR | 10-2008-0094412 | | 10/2008 | |
| KR | 10-1193605 | | 10/2012 | |
| KR | 20160069500 | | 6/2016 | |
| KR | 20160069500 | A * | 6/2016 | |
| KR | 10-2016-0112350 | | 9/2016 | |
| WO | WO9950603 | | 10/1999 | |
| WO | WO2009044627 | | 4/2009 | |
| WO | WO-2009044627 | A1 * | 4/2009 | F24F 13/082 |

OTHER PUBLICATIONS

International Search Report in International Application No. PCT/KR2017/014036, dated Mar. 30, 2018, 4 pages.

* cited by examiner

【FIG. 1】
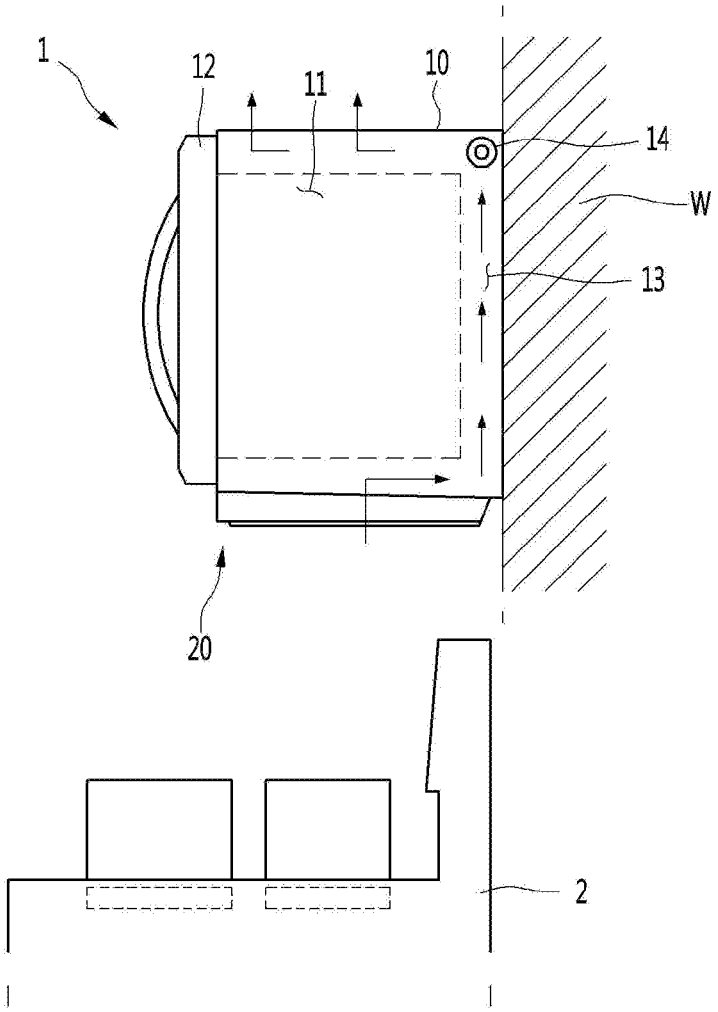

【FIG. 2】
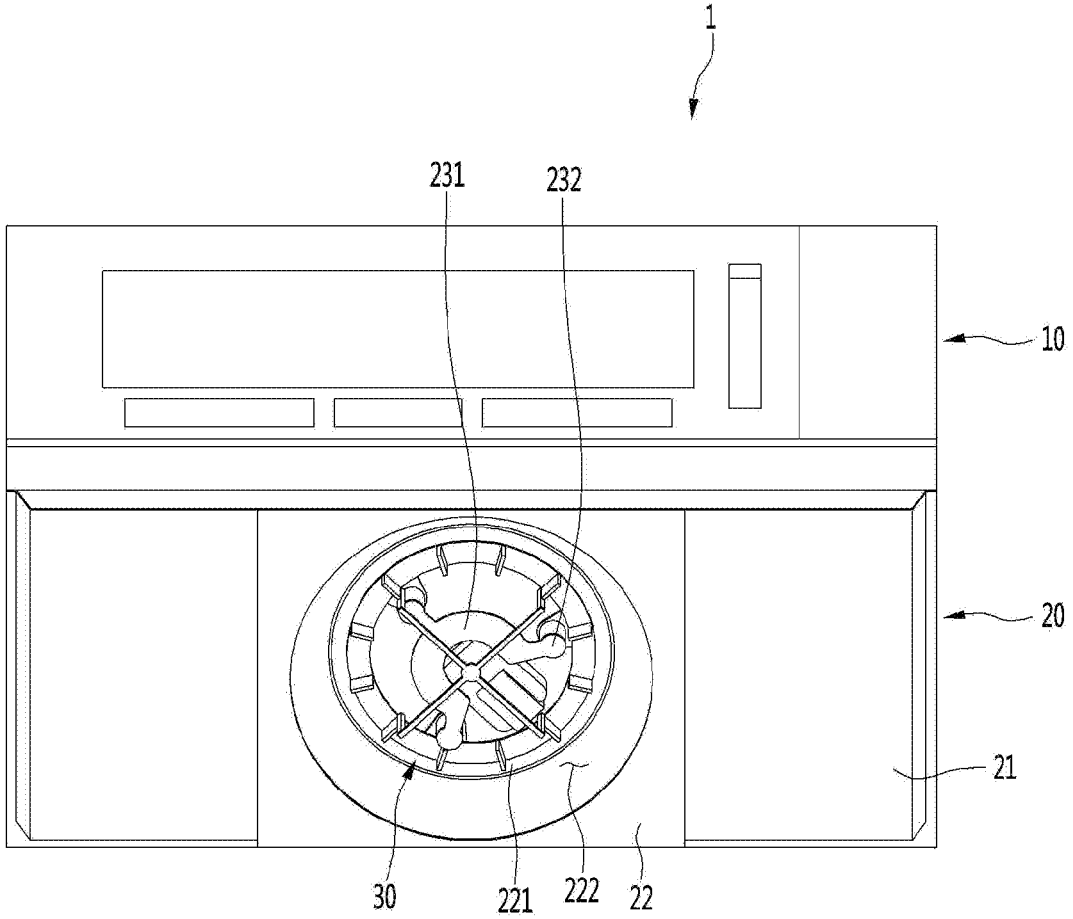

【FIG. 3】
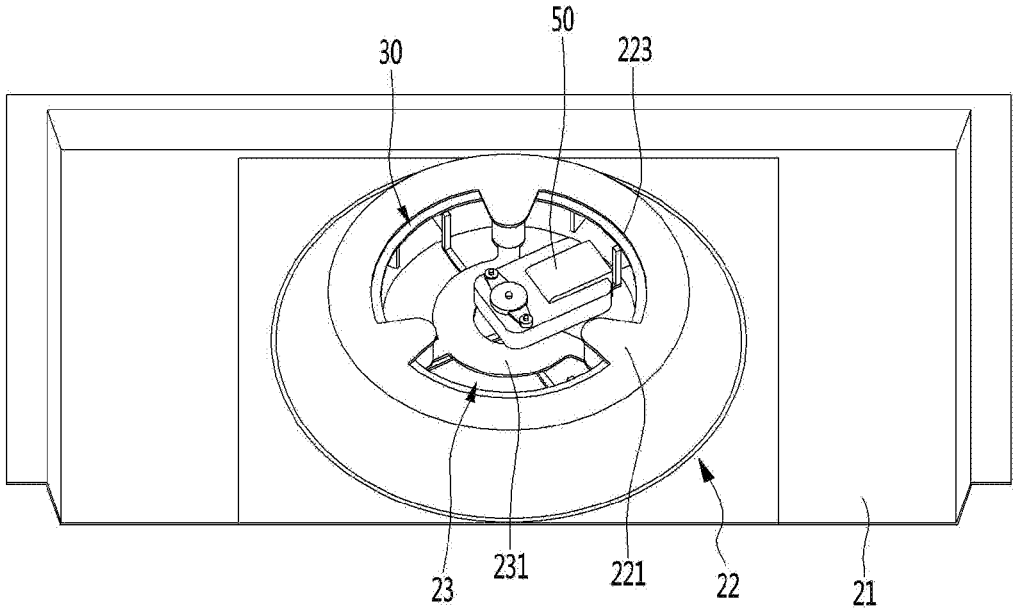

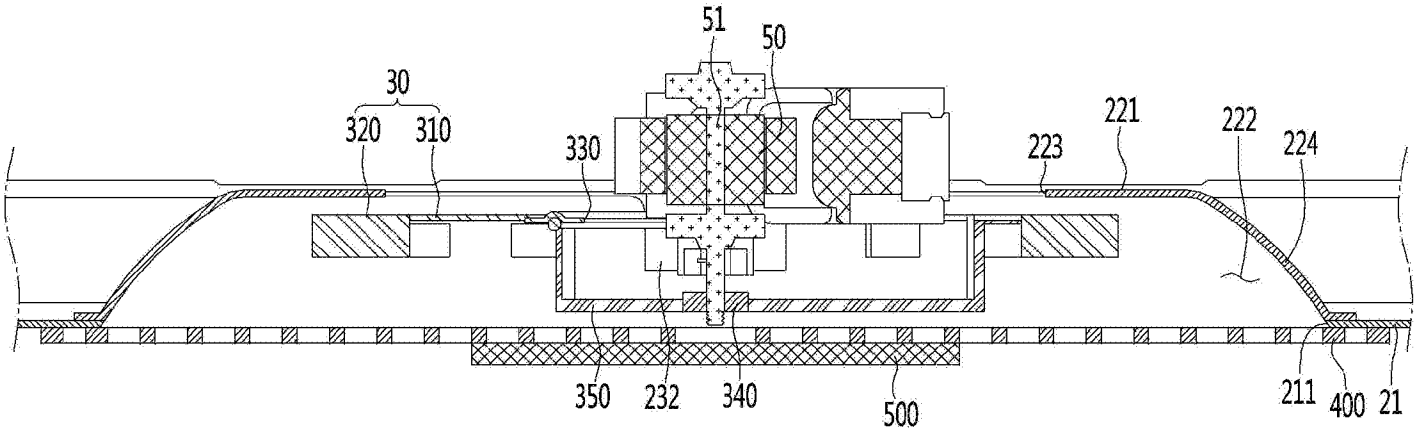
【FIG. 4】

【FIG. 5】
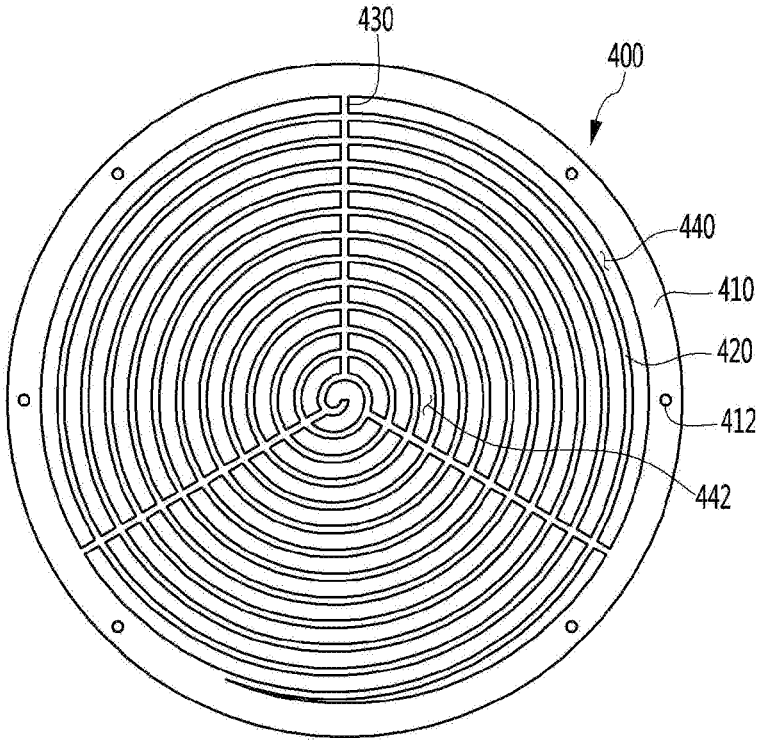

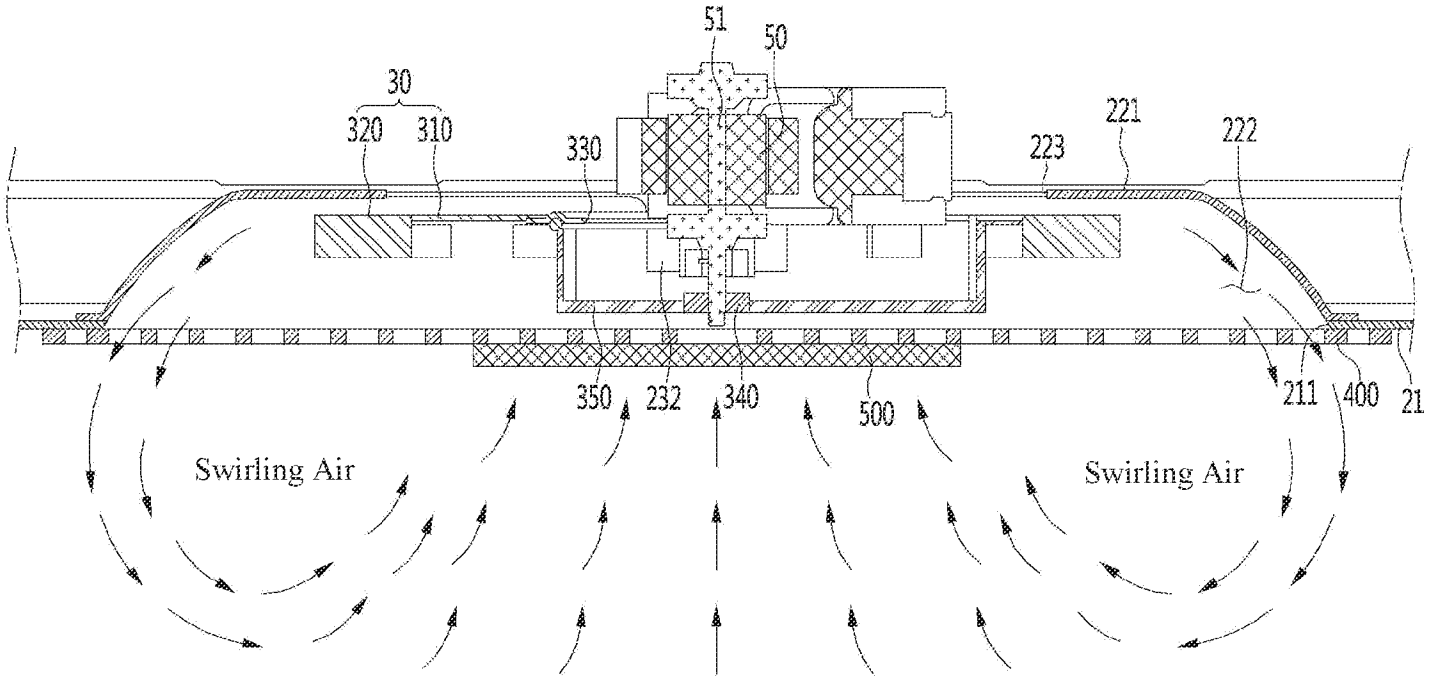
[FIG. 6]

【FIG. 7】
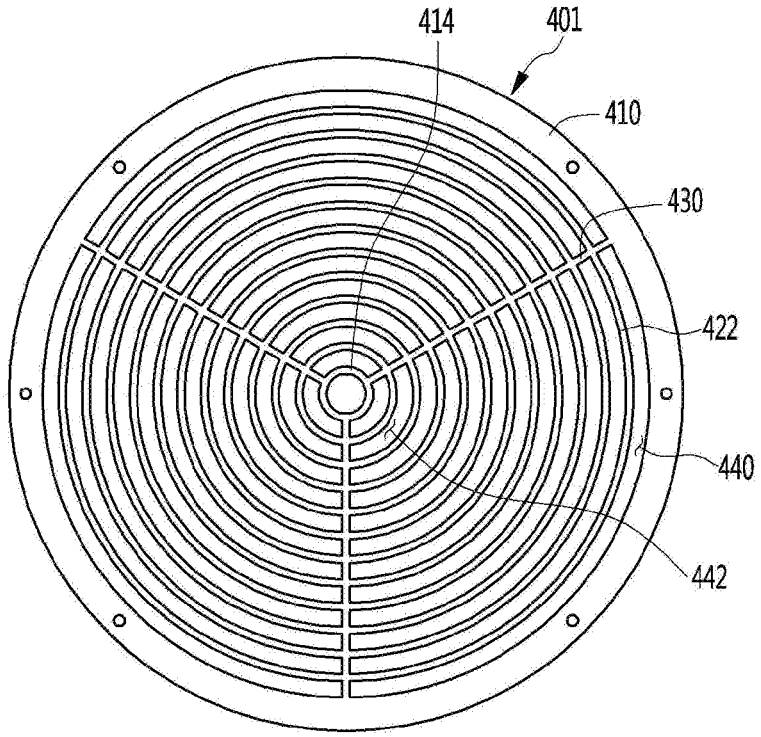

【FIG. 8】
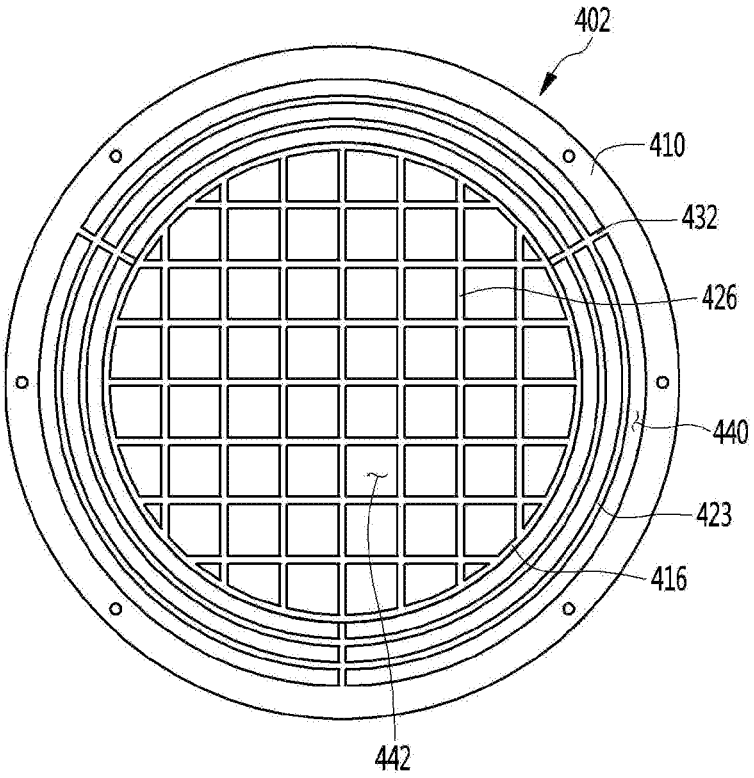

【FIG. 9】
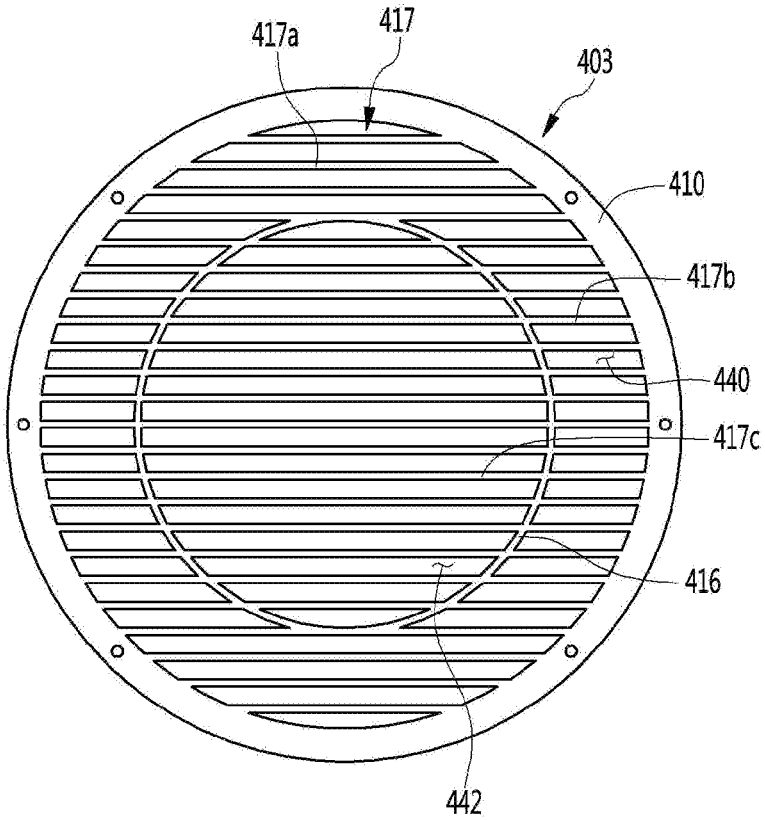

【FIG. 10】
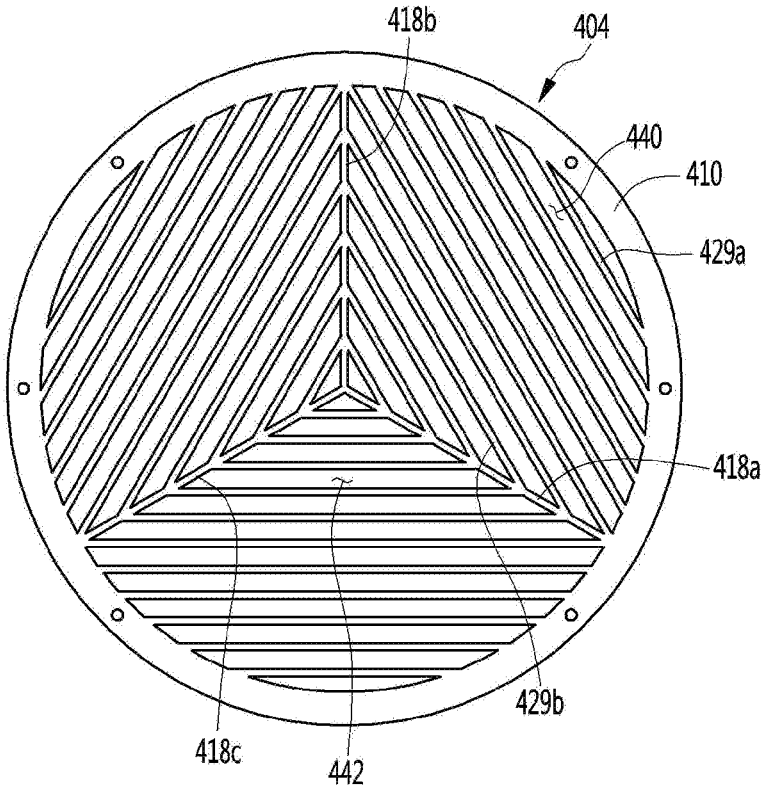

【FIG. 11】
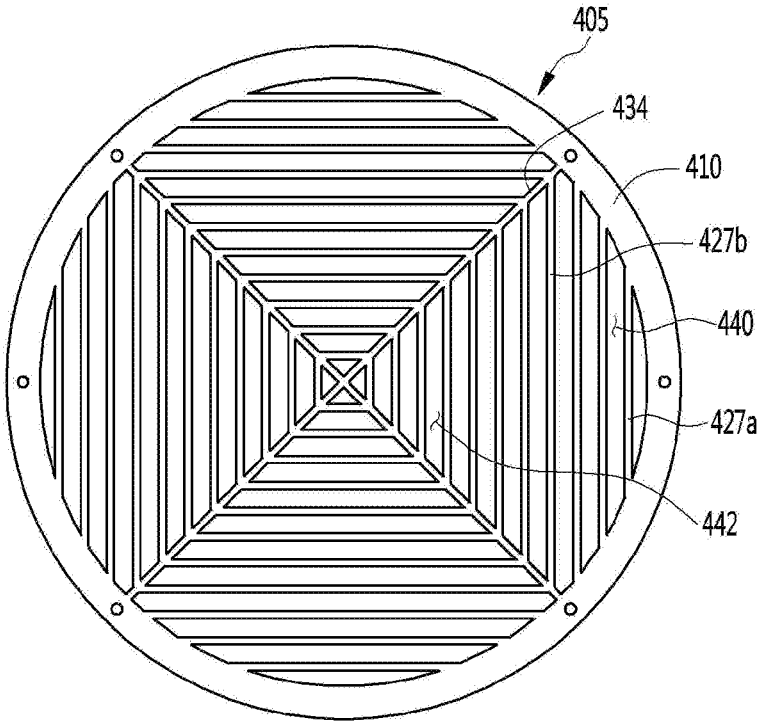

【FIG. 12】
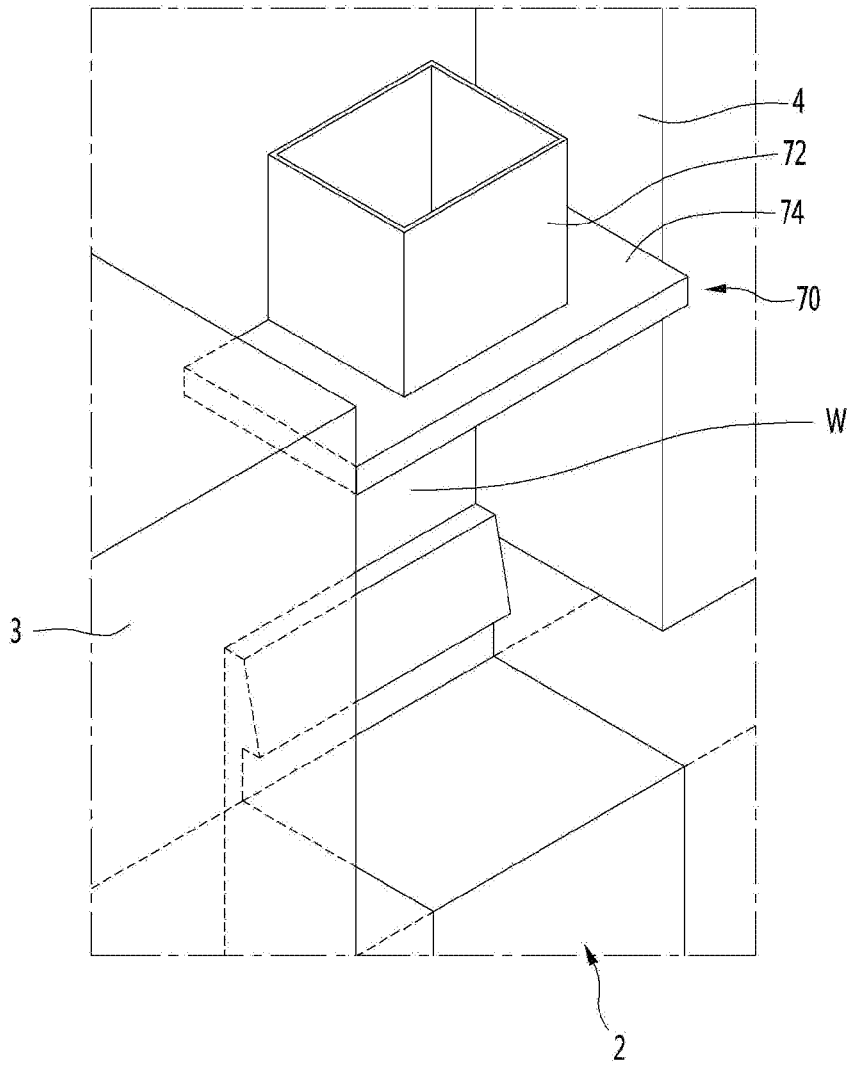

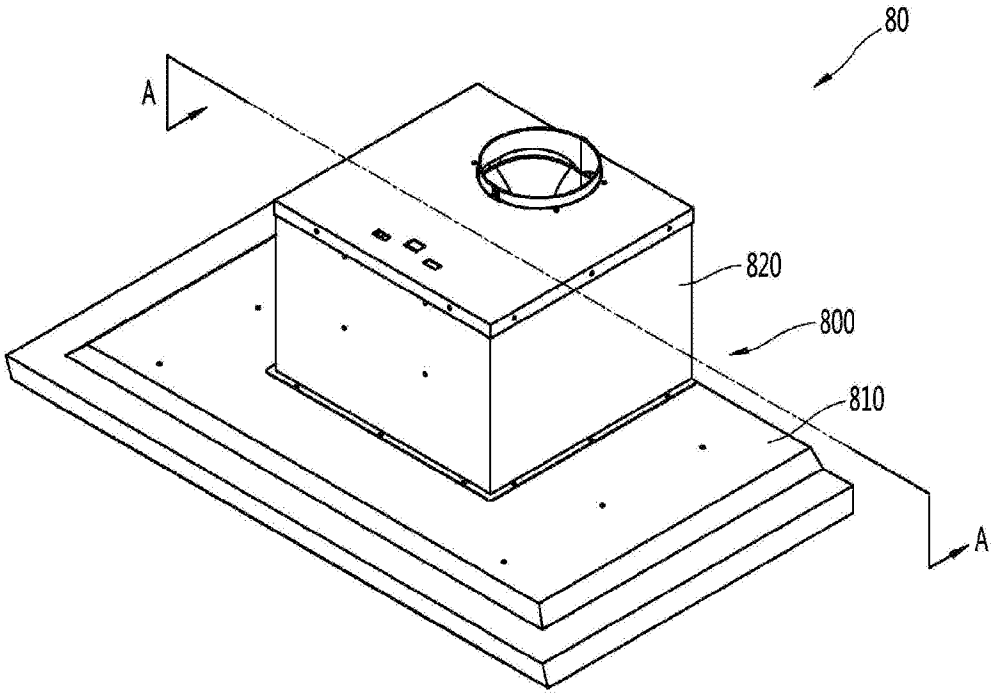
[FIG. 13]

【FIG. 14】
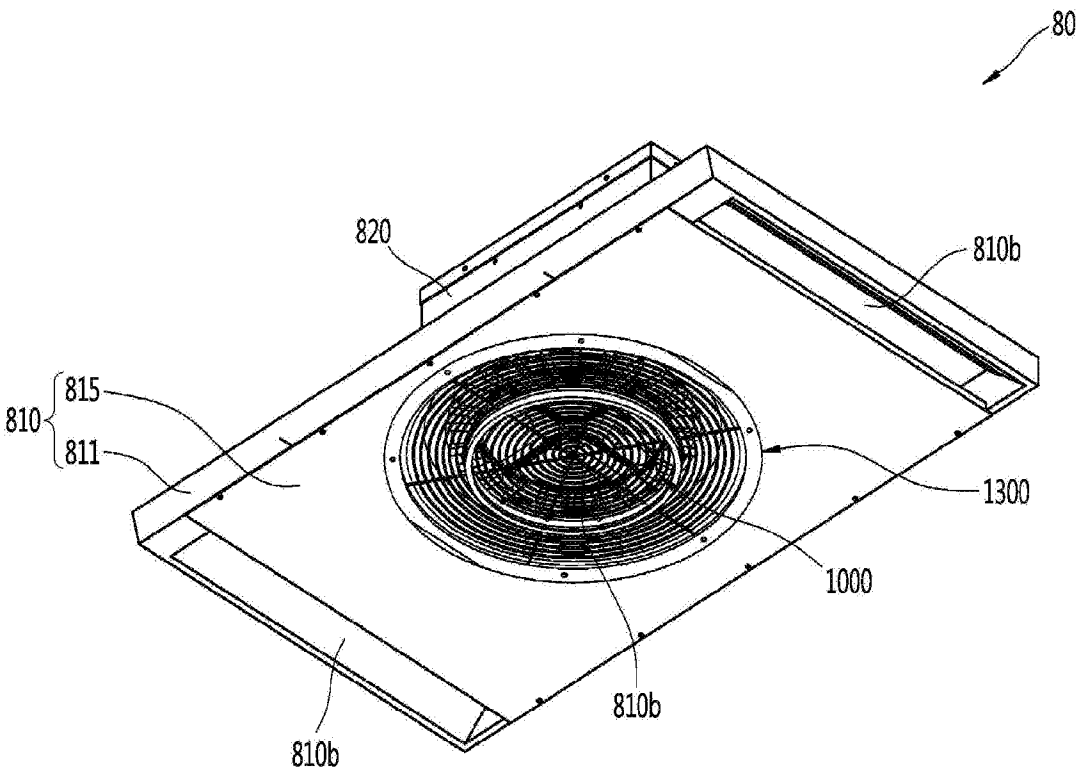

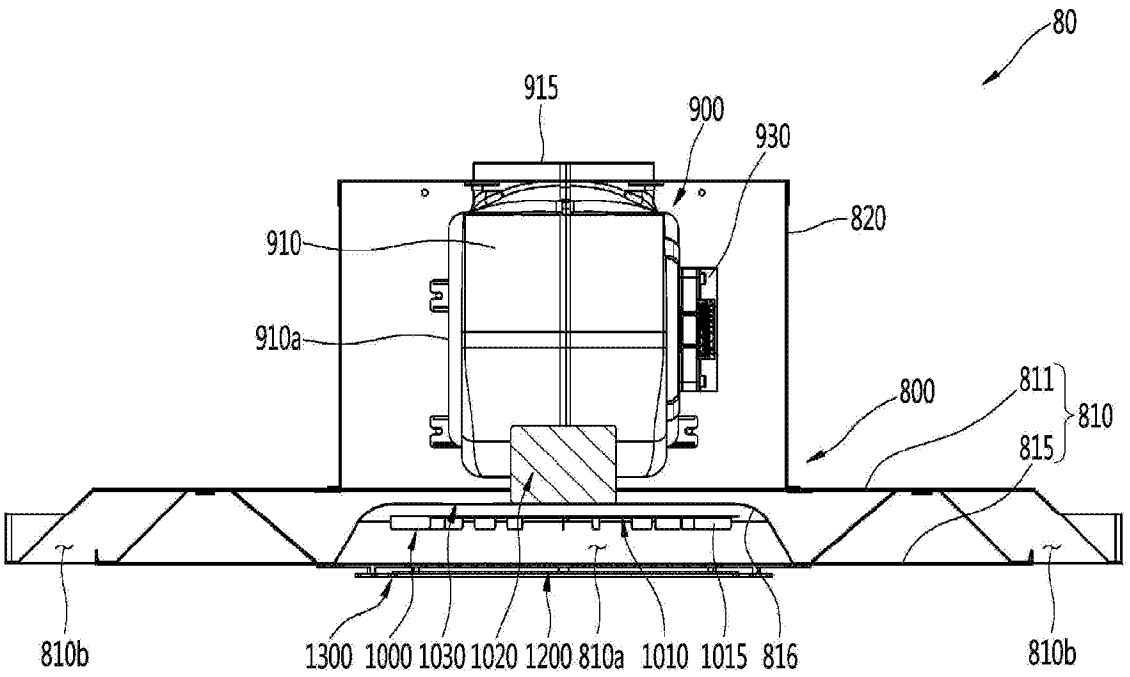
【FIG. 15】

【FIG. 16】
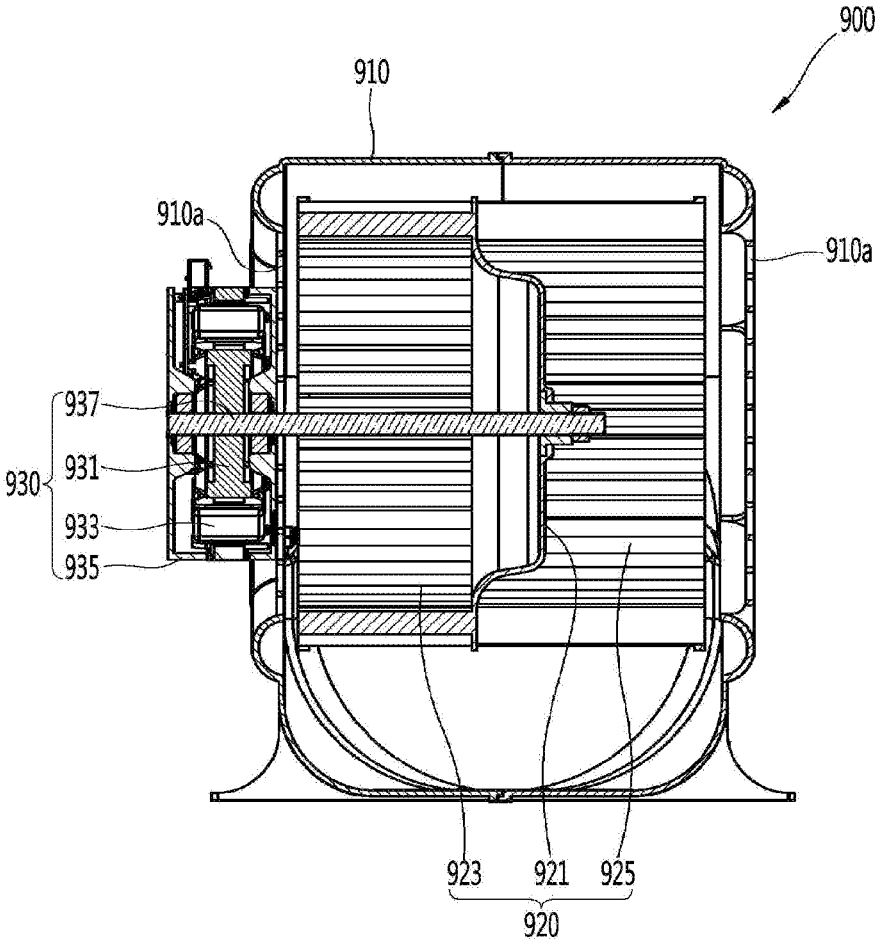

【FIG. 17】
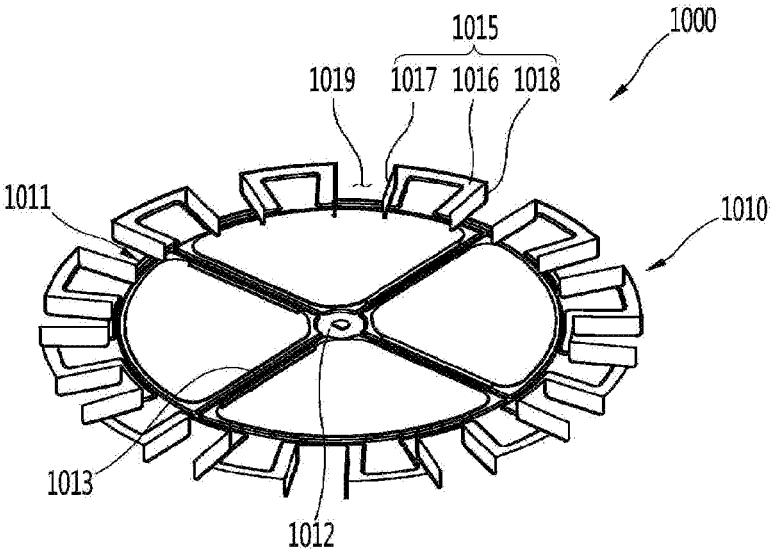

【FIG. 18】
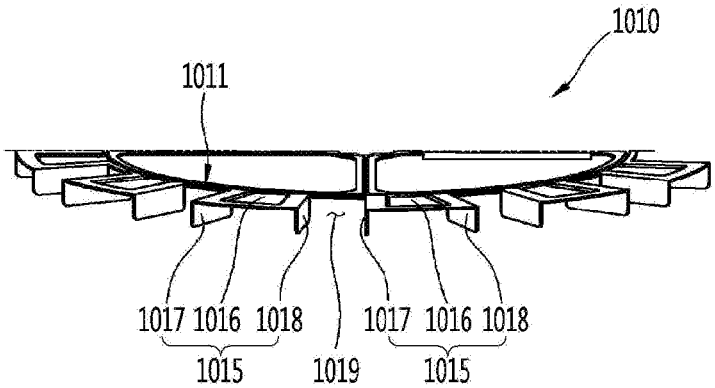

【FIG. 19】
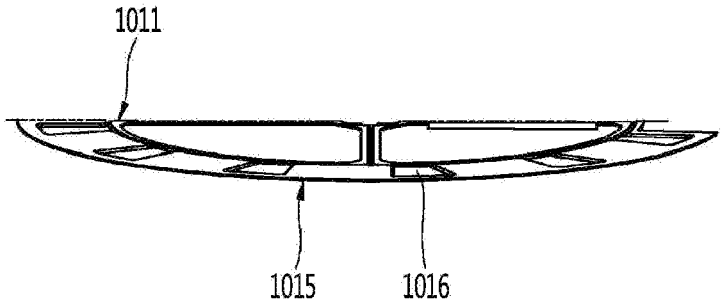

【FIG. 20】
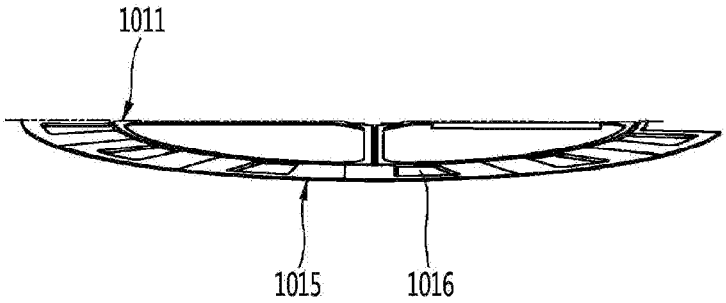

【FIG. 21】
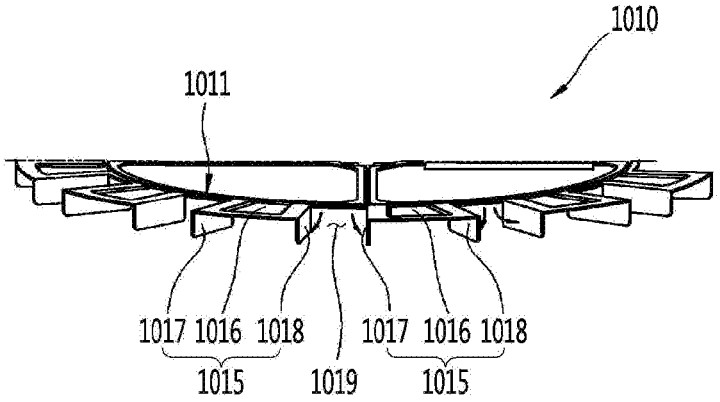

【FIG. 22】
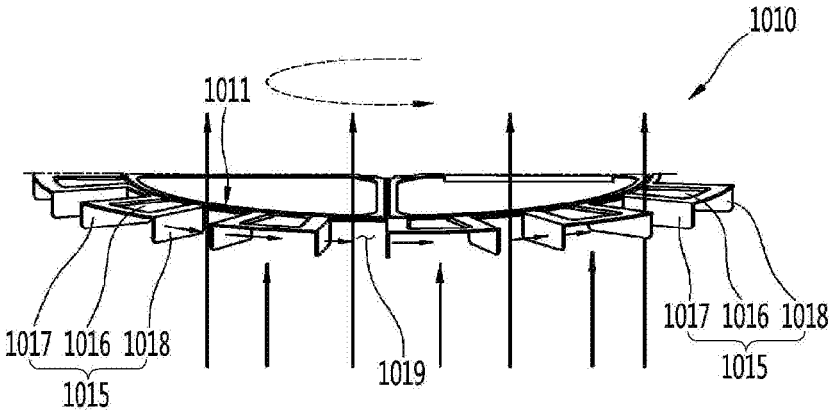

【FIG. 23】
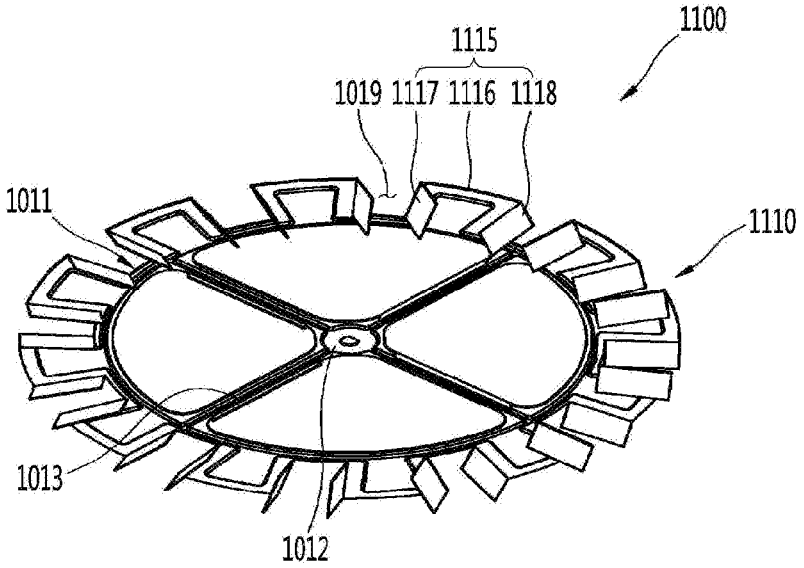

【FIG. 24】
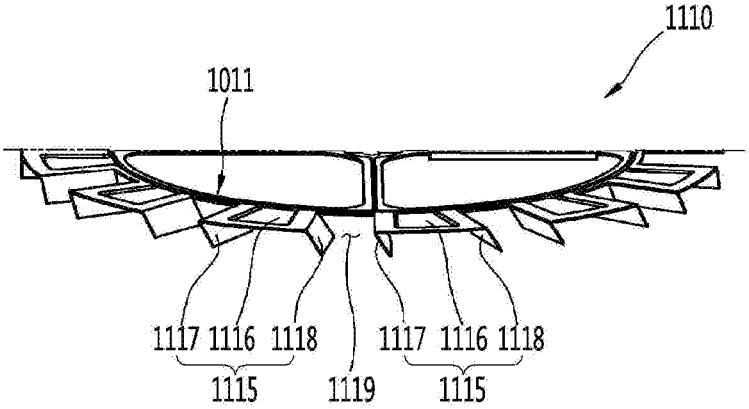

【FIG. 25】
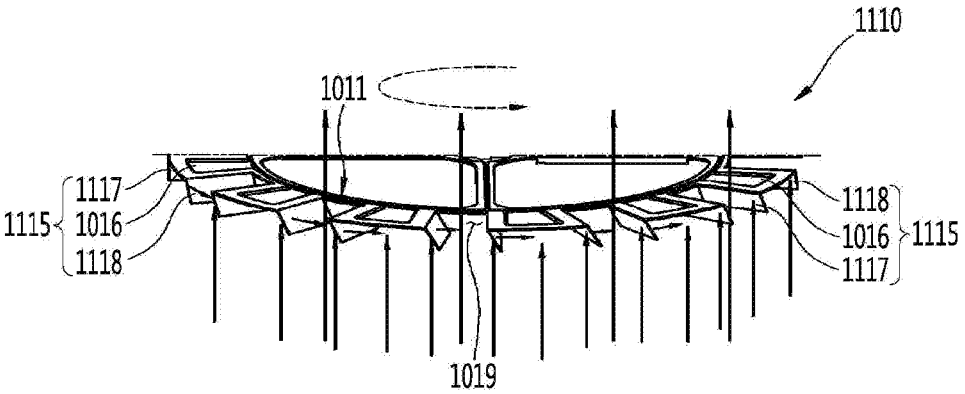

【FIG. 26】
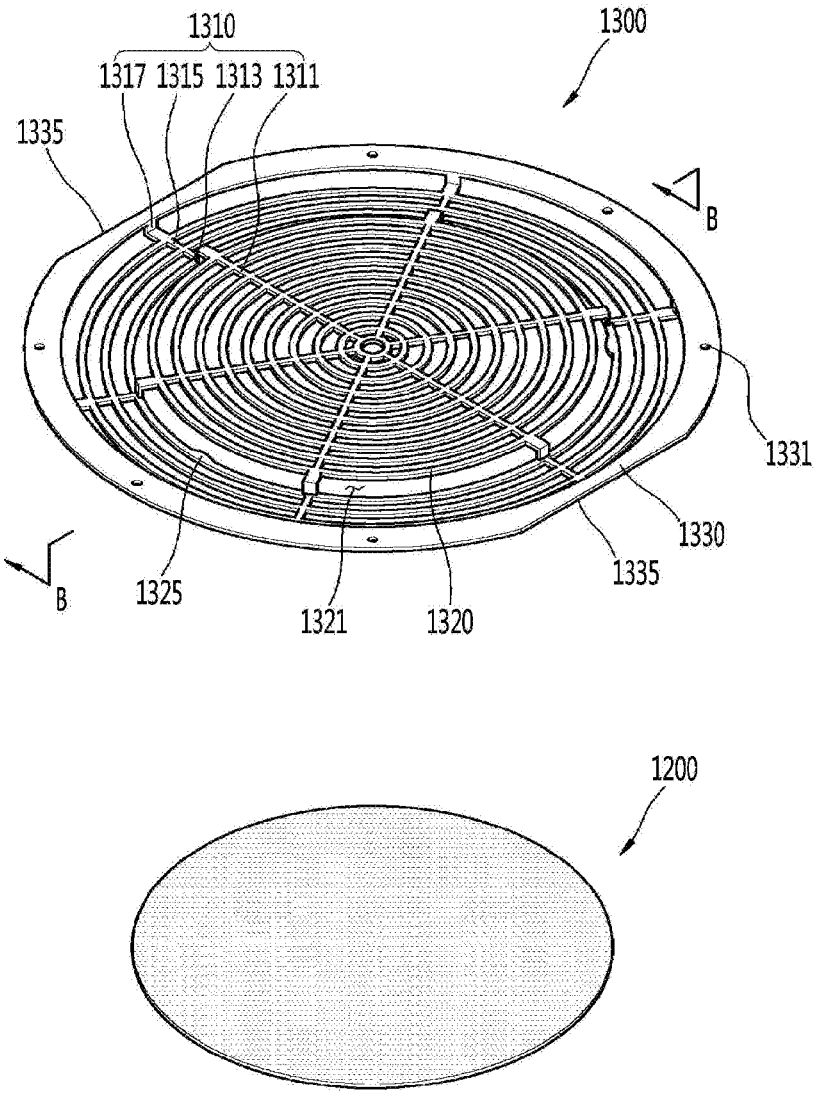

【FIG. 27】
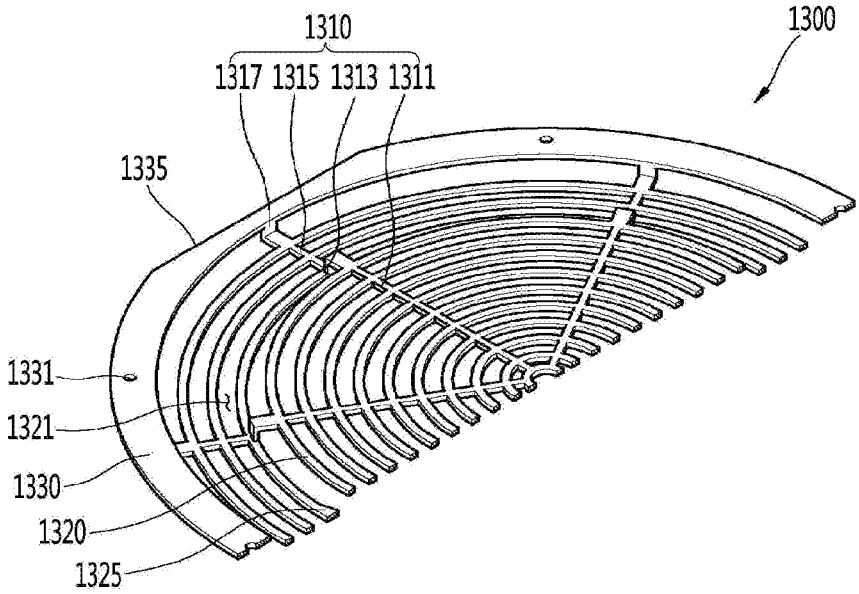

【FIG. 28】
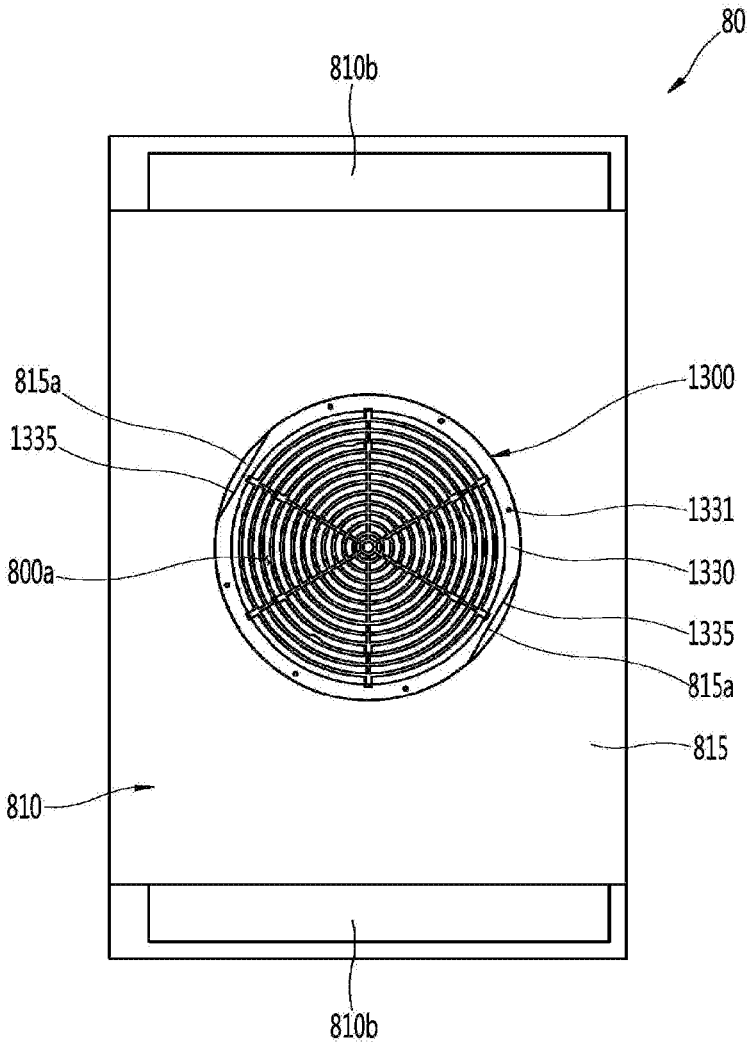

【FIG. 29】
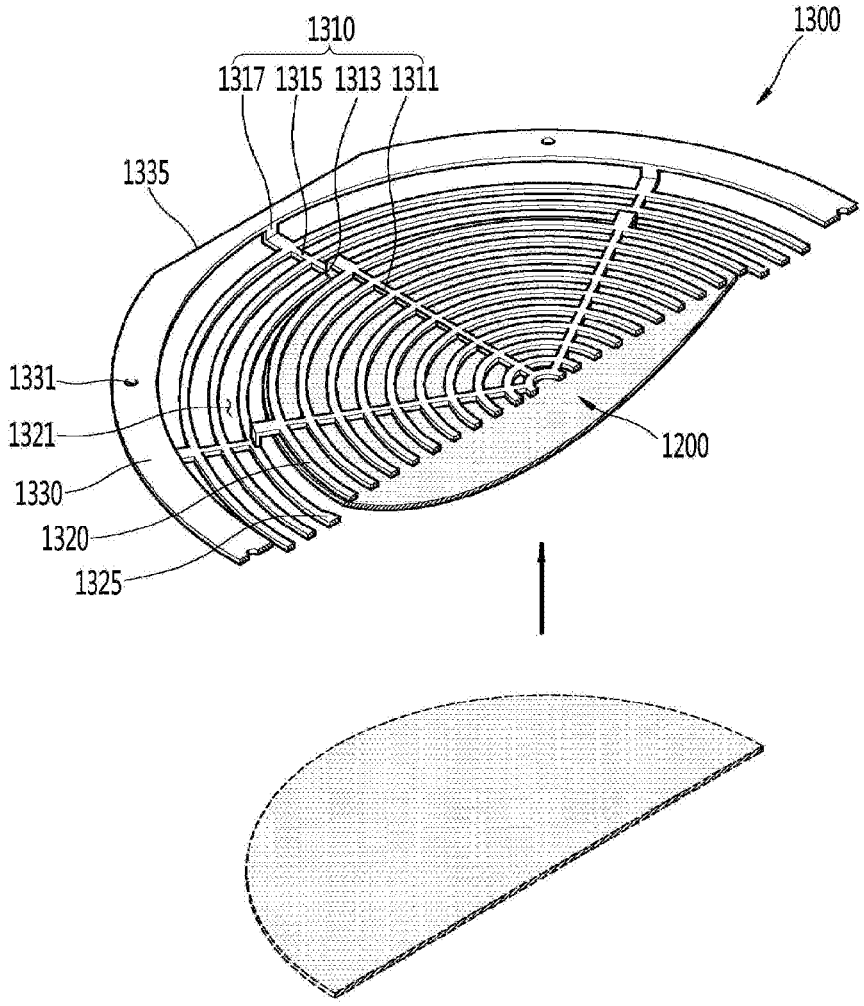

【FIG. 30】
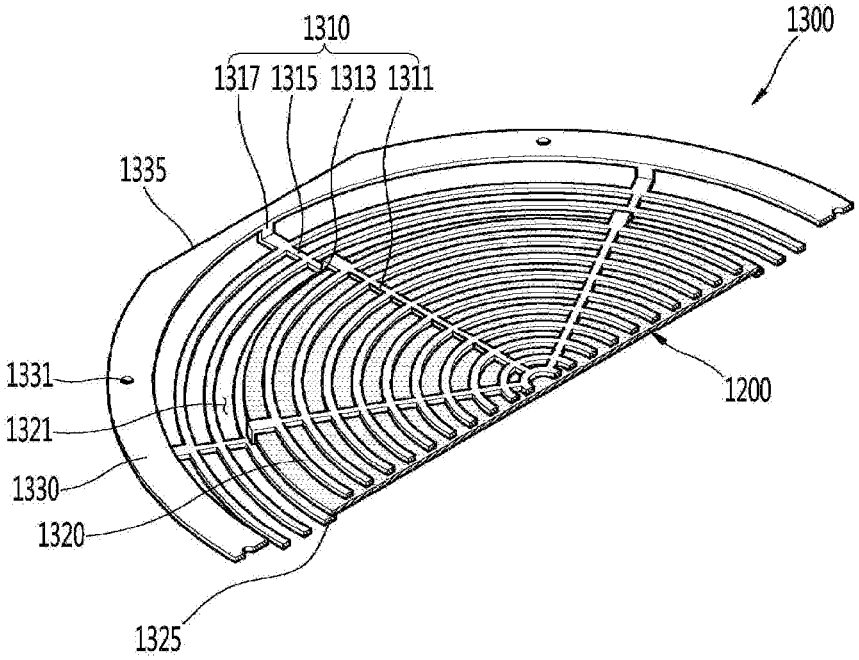

COOKWARE AND EXHAUST DEVICE

CROSS-REFERENCE TO RELATED APPLICATIONS

This application is a National Stage application under 35 U.S.C. § 371 of International Application No. PCT/KR2017/014036, filed on Dec. 1, 2017, which claims the benefit of Korean Patent Application No. 10-2017-0160370, filed on Nov. 28, 2017 and Korean Patent Application No. 10-2016-0163512, filed on Dec. 2, 2016. The disclosures of the prior applications are incorporated by reference in their entirety.

TECHNICAL FIELD

The present disclosure relates to a cooking device and a ventilation apparatus.

BACKGROUND

A ventilation apparatus is used in factories, homes, restaurants, and the like where many contaminants are generated. Particularly, the ventilation apparatus is useful when a partial contaminant source occurs on a floor away from an exhaust port, when it is difficult to install the exhaust port near the contamination source due to another installation, and when the contamination source occurs instantaneously.

In Korean patent application publication No. 2008-0094412 (publication date: Oct. 23, 2008), which is the prior art, discloses a vortex type ventilation apparatus.

The ventilation apparatus disclosed in the prior art uses a swirler including an exhaust pipe, a driving portion installed in the exhaust pipe, a rotating plate rotated by the driving portion, a plurality of blades provided at edges of the rotating plate to flow and suction the contaminants.

In this prior art, as the driving portion is installed in the exhaust pipe aligned with a hole defined in the swirler, a length of the exhaust pipe for installing the driving portion becomes longer. This causes restrictions on an installation position of the local ventilation apparatus.

Further, as the driving portion is disposed in the exhaust pipe, when the ventilation apparatus is once installed, it is difficult to repair and replace the driving portion.

Further, in the prior art, the swirler is exposed to outside, so that a safety of a user is poor.

DISCLOSURE

Technical Purpose

A purpose of the present disclosure is to provide a ventilation apparatus and a cooking device in which a swirler is prevented from being exposed to outside by a grill member.

In addition, a purpose of the present disclosure is to provide a ventilation apparatus and a cooking device that may facilitate suction and discharge of air via a grill member.

In addition, a purpose of the present disclosure is to provide a ventilation apparatus having an improved structure for an easy and effective installation of a structure for preventing contamination.

Technical Solution

An aspect of the present disclosure provides a ventilation apparatus including: a case having a flow hole defined therein; a flow guide positioned within the case, wherein the flow guide includes an inlet communicating with the flow hole and a guide surface inclined downwardly and outwardly; a swirler positioned in a region defined by the flow guide, wherein the swirler is rotated to discharge back a portion of air inflowed through the flow hole out of the case, and wherein the swirler has a plurality of blades; a driving motor for rotating the swirler; and a grill member for covering the swirler at outside of the case and for providing an air flow path.

The grill member may include grill ribs for defining a suction passage for suctioning the air and a discharge passage for discharging the air, and the discharge passage may be positioned outside the suction passage.

A portion of the gill ribs defining the discharge passage may be extended in a rounded manner.

A portion of the gill ribs defining the discharge passage may be extended spirally.

The grill member may include a ring-shaped outer frame, and a single grill rib may extend spirally toward a central point of the outer frame.

The grill member may further include a support rib extending in a radial direction of the outer frame and connecting the grill rib and the outer frame with each other to prevent sagging of the spirally-extending grill rib.

Some of the grill ribs defining the discharge passage may extend in a circular manner.

The plurality of grill ribs may define the discharge passage and the suction passage, and each of all of the plurality of grill ribs may extend in a circular manner.

The grill member may further include: a ring-shaped outer frame fixed to the case; and a support rib extending in a radial direction of the outer frame and connecting the plurality of grill ribs with each other.

The portion of the grill ribs defining the discharge passage may extend in an arc shape.

The grill member may include a ring-shaped outer frame fixed to the case, and a plurality of support ribs, each extending in a radial direction of the outer frame. In addition, the portion of the grill ribs extending in the arc shape may connect two adjacent support ribs with each other.

The grill ribs may include: a first grill rib defining the discharge passage and extending in a rounded manner; and a second grill rib defining the suction passage and having an extension shape or manner different from an extension shape or manner of the first grill rib.

The ventilation apparatus may further include a filter detachably mounted on the grill member and covering the suction passage.

The grill member may include: a radial member including a plurality of linear ribs extending in a radial direction and being connected to each other; a concentric member having a plurality of circular ribs arranged concentrically and being connected to the radial member; and an outer frame member disposed outside the concentric member and connected to the radial member, wherein the outer frame member is coupled to a main body.

The radial member may be divided into an inner section having a radial center of the radial member, and an outer section disposed outside the inner section. In addition, a first connection portion may be formed between the inner section and the outer section to connect the inner section and the outer section in a stepwise manner in a vertical direction.

The first connection portion may connect the inner section and the outer section such that the inner section is positioned higher than the outer section.

The grill member may include first and second regions. The first region may contain the inner section therein and the second region may contain the outer section therein. Further, the first region and the second region may be arranged concentrically, and the first connection portion may define a boundary between the first region and the second region.

A second connection portion may be formed between the outer frame member and the outer section to connect the outer section and the outer frame member such that the outer section is positioned lower than the outer frame member. In addition, the outer frame member and the inner section may be flush with each other.

The grill member may further include a protrusion protruding from the concentric member connected to the outer section toward the radial center of the radial member to support the filter thereon.

The protrusion may include a plurality of protrusions arranged to be spaced apart from each other by a predetermined interval along a circumferential direction of the circular rib.

The protrusion may have a rounded shape.

The outer frame member may be formed in a circular ring shape. In addition, a plurality of fastening holes for fastening the case and the outer frame member may be defined in the outer frame member and spaced apart from each other along a circumferential direction of the outer frame member.

An alignment cut may be defined in an outer rim of the outer frame member and engaged with an alignment structure of the case to guide an installation position of the grill member such that the fastening holes are aligned with predetermined positions of the case respectively.

Another aspect of the present disclosure provides a cooking device may including: a main body having a cooking space defined therein for cooking food and a suction fan for suctioning contaminated air; and a ventilation apparatus disposed below the main body to form a vortex. The ventilation apparatus may include: a case provided below the main body and having a flow hole defined therein; a flow guide positioned within the case, wherein the flow guide includes an inlet communicating with the flow hole and a guide surface inclined downwardly and outwardly; a swirler positioned in a region defined by the flow guide, wherein the swirler is rotated to discharge back a portion of air inflowed through the flow hole out of the case, and wherein the swirler has a plurality of blades; a driving motor disposed in the case and rotating the swirler; and a grill member for covering the swirler at an outside of the case and for providing an air flow path. The grill member may include grill ribs for defining a suction passage for suctioning the air and a discharge passage for discharging the air, and the discharge passage may be positioned outside the suction passage.

A portion of the gill ribs defining the discharge passage may be extended in a rounded manner.

Technical Effect

According to the proposed invention, the grill member is disposed below the swirler to cover the swirler, and therefore, the exposure of the swirler is prevented, thereby improving a safety.

Further, the grill member defines the suction passage and the discharge passage and the grill ribs defining the discharge passage extend in a direction same as or similar to a flow direction of air forming a vortex flowing in a spiral manner. Therefore, a discharge performance is improved and thus a suction performance is improved.

Further, according to the present disclosure, the vortex forming apparatus is positioned in the case forming the ventilation apparatus. Therefore, the vortex forming apparatus may be easily accessed by the user, thereby facilitating the service of the vortex forming apparatus.

The filter may be mounted and replaced easily and quickly only by a simple and easy operation of inserting the filter into the filter mounting space defined in the grill member or extracting the filter from the filter mounting space. Thus, a structure for preventing the contamination of the ventilation apparatus may be easily and efficiently mounted.

BRIEF DESCRIPTION OF DRAWINGS

FIG. 1 illustrates a cooking device according to a first embodiment of the present disclosure.

FIG. 2 is a bottom view of a ventilation apparatus according to an embodiment of the present disclosure.

FIG. 3 is a top view of a ventilation apparatus according to a first embodiment of the present disclosure.

FIG. 4 is a vertical cross-section view of a ventilation apparatus according to a first embodiment of the present disclosure.

FIG. 5 is a plan view of a grill member according to a first embodiment of the present disclosure.

FIG. 6 illustrates a flow of air generated during an operation of a ventilation apparatus according to a first embodiment of the present disclosure.

FIG. 7 is a plan view of a grill member according to a second embodiment of the present disclosure.

FIG. 8 is a plan view of a grill member according to a third embodiment of the present disclosure.

FIG. 9 is a plan view of a grill member according to a fourth embodiment of the present disclosure.

FIG. 10 is a plan view of a grill member according to a fifth embodiment of the present disclosure.

FIG. 11 is a plan view of a grill member according to a sixth embodiment of the present disclosure.

FIG. 12 illustrates a ventilation apparatus according to a seventh embodiment of the present disclosure.

FIG. 13 is a perspective view illustrating a ventilation apparatus according to an eighth embodiment of the present disclosure.

FIG. 14 is a bottom perspective view of a ventilation apparatus illustrated in FIG. 13.

FIG. 15 is a cross-sectional view taken along a line "A-A" in FIG. 13.

FIG. 16 is a cross-sectional view illustrating an internal structure of a blower illustrated in FIG. 15.

FIG. 17 is a perspective view of a portion of a vortex forming apparatus illustrated in FIG. 15.

FIG. 18 is a front view of a vortex forming apparatus illustrated in FIG. 17.

FIGS. 19 to 21 illustrate a manufacturing process of a vortex forming apparatus illustrated in FIG. 18.

FIG. 22 illustrates a flow of air in a vortex forming apparatus illustrated in FIG. 18.

FIG. 23 is a perspective view illustrating another example of a vortex forming apparatus illustrated in FIG. 17.

FIG. 24 is a front view of a vortex forming apparatus illustrated in FIG. 23.

FIG. 25 illustrates a flow of air in a vortex forming apparatus illustrated in FIG. 24.

FIG. 26 is a perspective view illustrating a grill member and a filter illustrated in FIG. 15.

FIG. 27 is a cross-sectional view taken along a line "B-B" in FIG. 26.

FIG. 28 is a bottom view illustrating a state in which a grill member is coupled to a main body.

FIGS. 29 and 30 are cross-sectional views illustrating a state in which a filter is installed on a grill member.

DETAILED DESCRIPTIONS

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. It will be understood that when a component is referred to as being "connected to", or "coupled to" another component, it can be directly on, connected to, or coupled to the other component, or one or more intervening components may be present.

FIG. 1 illustrates a cooking device according to a first embodiment of the present disclosure.

Referring to FIG. 1, a cooking device 1 according to a first embodiment of the present disclosure may be installed on a wall W and the like of a kitchen as an example. That is, in the present embodiment, the cooking device 1 may be a wall-mountable microwave oven. As long as the cooking device 1 may be installed on the wall W, there is no restriction on a type of the cooking device 1.

The cooking device 1 may include a main body 10 having a cooking space 11 defined therein and a door 12 connected to the main body 10 to open and close the cooking space 11.

Therefore, the cooking device 1 may perform a cooking of foods housed in the cooking space 11.

The cooking device 1 may further include a ventilation apparatus 20 for suctioning contaminated air from outside and discharging back the suctioned air out of the cooking device 1.

The ventilation apparatus 20 may be disposed on a bottom surface of the main body 10, but not limited thereto. Further, the main body 10 may include an outlet (not shown) through which air flowing by the ventilation apparatus 20 is discharged.

In addition, the main body 10 may further include a suction fan 14 that operates to suction the contaminated air and an air flow path 13 through which the contaminated air flows.

Therefore, the contaminated air suctioned by the ventilation apparatus 20 may be discharged through the outlet after flowing through the air flow path 13 in the main body 10. Alternatively, the outlet of the ventilation apparatus 20 may be arranged to communicate with a ventilation apparatus hole defined in the wall in a state where the ventilation apparatus 20 is installed on the main body 10.

The ventilation apparatus 20 may operate independently of a cooking operation of the main body 10.

That is, only the cooking may be performed in the cooking device 1, or only the exhausting may be performed by the ventilation apparatus 20 in the cooking device 1, or the cooking and the exhausting may be simultaneously performed.

The cooking device 1 may be located above a further cooking device 2 in the kitchen, in one example. The ventilation apparatus 20 may suction and discharge contaminated air generated in a process of cooking food by the further cooking device 2.

Hereinafter, the ventilation apparatus 20 will be described in detail.

FIG. 2 is a bottom view of a ventilation apparatus according to an embodiment of the present disclosure. In addition, FIG. 3 is a top view of a ventilation apparatus according to a first embodiment of the present disclosure. In addition, FIG. 4 is a vertical cross-section view of a ventilation apparatus according to a first embodiment of the present disclosure. In addition, FIG. 5 is a plan view of a grill member according to a first embodiment of the present disclosure.

Referring to FIGS. 2 to 5, the ventilation apparatus 20 according to the first embodiment of the present disclosure may include a case 21 providing a flow path for the contaminated air.

The case 21 may be coupled to the bottom surface of the main body 10. The case 21 may have a flow hole 211 defined therein through which the air flows.

The case 21 may have a flow guide 22 having an inlet 223 through which the air inflows.

The flow guide 22 may be fastened to the case 21 by a fastening member or may be integrally formed with the case 21.

The ventilation apparatus 20 may further include a vortex forming apparatus. The vortex forming apparatus may include a driving motor 50 and a swirler 30 that receives power from the driving motor 50 and rotates.

The swirler 30 rotates to discharge back a portion of the air inflowed through the flow hole 211 out of the case 21.

The driving motor 50 may be mounted in a mounting portion 23. The mounting portion 233 may be coupled to a top surface of the flow guide 22 or may be integrally formed on an upper side of the flow guide 22.

The flow guide 22 may include a depression 221 for guiding a flow of the air. The inlet 223 may be formed in the depression 221, in one example.

The swirler 30 may be located in a space 222 defined by the depression 221. Thus, the swirler 30 may be positioned below the inlet 223.

The mounting portion 23 may include a supporter 231 to which the driving motor 50 is coupled and supporting the driving motor 50 and a connection portion 232 for connecting the supporter 231 to the flow guide 22.

The supporter 231 may be positioned lower than the inlet 223. Therefore, the driving motor 50 may pass through the inlet 223 while the driving motor 50 is mounted on the supporter 231.

The driving motor 50 may be fastened to the supporter 231 at an above of the supporter 231.

Thus, a portion of the driving motor 50 may be positioned higher than the inlet 223, while the other portion thereof may be positioned lower than the inlet 223.

According to the present embodiment, as the driving motor 50 is mounted in the mounting portion 23 of the case 21, the driving motor 50 may be easily installed and a vertical level of the ventilation apparatus 20 may be reduced.

Particularly, as the driving motor 50 passes through the inlet 223 of the case 21 and a portion of the driving motor 50 is positioned lower than the inlet 223, the vertical level of the ventilation apparatus 20 may be further reduced.

At least a portion of the supporter 231 may be positioned to overlap the inlet 223 vertically so that the driving motor 50 passes through the inlet 223.

In this connection, the supporter 231 may be formed in a shape like a "C-shape" such that the supporter 231 stably supports the driving motor 50 and a flow resistance caused by the supporter 231 is minimized.

The swirler 30 may include a rotating plate 310 that rotates and a plurality of blades 320 arranged in a circumferential direction along a rim of the plate 310.

The rotation plate 310 may have a through hole 330 defined therein through which the contaminated air passes.

The swirler 30 may include a shaft coupling portion 340 for coupling with a shaft 51 of the driving motor 50 and at least one connecting rib 350 for connecting the shaft coupling portion 340 to the rotating plate 310.

The through hole 330 may be arranged to overlap with the inlet 223 of the case 21 in the vertical direction for a smooth flow of the contaminated air.

The plurality of blades 320 may be disposed on a bottom surface of the rotating plate 310 and may be spaced apart from each other in the circumferential direction of the rotating plate 310. The shaft coupling portion 340 may be positioned below the rotating plate 310.

Therefore, the shaft 51 of the driving motor 50 may be connected to the shaft coupling portion 340 after passing through the through hole 330 of the rotating plate 310. At this time, a portion of the driving motor 50 may pass through the through hole 330 of the rotating plate 310.

The shaft coupling portion 340 may be positioned lower than the plurality of blades 320. In addition, the shaft coupling portion 340 may be positioned in the space 222 defined by the depression 221.

The supporter 231 may be positioned above the shaft coupling portion 340. The supporter 231 may pass through the through hole 330 of the rotating plate 310, although not limited thereto.

According to the embodiment, as the shaft coupling portion 340 is connected to the shaft 51 of the driving motor 50 while being positioned below the rotating plate 310, a distance between the swirler 30 and the driving motor 50 is minimized so that the vertical level of the ventilation apparatus 20 may be reduced.

The flow guide 22 may include a guide surface 224 which is inclined downwardly and outwardly of a central portion such that a vortex may be formed below the flow guide 22 by the swirler 30.

The guide surface 224 may be an inclined surface or a rounded surface.

When the swirler 30 rotates in one direction, the blade 320 of the swirler 30 pushes out a portion of the contaminated air flowing toward the through hole 330 of the rotating plate 310 outwardly of the rotating plate 310 in the radial direction.

In this connection, in order to form the vortex below the flow guide 22, the air pushed out in the radial direction should flow outwardly of a center of the swirler 30 while flowing downwardly. The guide surface 224 is inclined downwardly and outwardly such that the air pushed out in the radial direction flows downwardly.

Since the flow guide 22 includes the guide surface 224 as described above, a flow direction of the air pushed outwardly of the radial direction of the rotating plate 310 by the blade 320 of the swirler 30 is changed downwardly by the guide surface 224.

As the air pushed by the blade 320 of the swirler 30 flows along the guide surface 224, air deviated from the guide surface 224 of the flow guide 22 may flow in a downwardly inclined manner.

When the contaminated air passes through the flow hole 211 of the case 21, not only the contaminated air passing through the flow hole 211 but also surrounding air passes through the flow hole 211 of the case 21. The vortex may be formed below the swirler 30 by this flow of air.

That is, as the flow guide 22 guides the air flowing in the radial direction of the swirler 30 downwardly, the vortex may be effectively formed below the swirler 30.

The ventilation apparatus 20 may further include a grill member 400 coupled to the case 21 and covering the swirler 30.

The grill member 400 may be disposed on an outer surface of the case 21 and coupled to the case 21.

The air below the ventilation apparatus 20 may pass through the grill member 400 and ascend. A portion of the air that has passed through the grill member 400 passes through the inlet 223 of the flow guide 22, and the other portion thereof flows in the radial direction by the swirler 30, then descends along the guide surface 224, and is discharged back out of the ventilation apparatus 20 through the grill member 400.

That is, the grill member 400 not only provides a suction passage for the air, but also provides a discharge passage for the air to form the vortex.

The ventilation apparatus 20 may further include a filter 500 disposed below the grill member 400 for filtering the air flowing into the ventilation apparatus 20.

In this connection, the filter 500 may be installed on a central portion of the grill member 400 and may have a diameter smaller than a diameter of the grill member 400. In one example, the filter 500 may be arranged on the grill member 400 to overlap with a portion or all of the suction passage in the vertical direction.

Accordingly, the filter 500 performs the filtering before the air passes through the grill member 400, but does not act as a passage resistance of the air discharged through the grill member 400.

The contaminated air generated during the cooking process of the food contains oil content. The oil content is filtered by the filter 500, so that the passage in the ventilation apparatus 20 may be less contaminated by the oil. In the present disclosure, since the filter 500 is installed and supported on the grill member 400, the grill member 400 may be referred to as a filter support.

Referring to FIG. 5, in one example, the grill member 400 may be formed in a disc shape, but is not limited thereto, and may be formed in a polygonal plate shape.

The grill member 400 may include an outer frame 410 having a diameter larger than a diameter of the flow hole 211 of the case 21. The outer frame 410 may include one or more fastening holes 412 to be fastened to the case 21 by a fastening member such as a screw.

The outer frame 410 may be formed in a ring shape, but is not limited thereto.

The grill member 400 may include grill ribs 420 extending spirally outwardly of a central point of an inner region of the outer frame 410. That is, the grill ribs 420 are extended in a rounded manner and are continuous. Alternatively, the grill rib 420 may be described as being extending spirally from an inner peripheral surface of the outer frame 410 toward the central point.

Further, in order to prevent sagging of the spirally extending grill ribs 420, the grill member 400 may further include a support rib 430 (extending in the radial direction) extending from the inner peripheral surface of the outer frame 410 to the central portion.

In this connection, the grill ribs 420 and the support rib 430 may be integrally formed.

In addition, as the grill ribs 420 extend spirally, the grill rib 420 defines a plurality of air flow paths.

In this connection, some of the plurality of air flow paths serve as a discharge passage 440 and remaining air flow paths serve as a suction passage 442.

The suction passage 442 is positioned at the central portion of the grill member 400 and the discharge passage 440 is positioned to surround the suction passage 442. That is, the suction passage 442 is positioned inwardly of the discharge passage 440.

In this connection, the filter 500 may be disposed to partially or entirely cover the suction passage 442.

In the present disclosure, when the swirler 30 rotates, air flowing toward a center of rotation of the swirler 30 flows in the radial direction by the blade 320 of the swirler 30. In this connection, the air flowing in the radial direction actually flows outwardly in a spiral manner by the rotation of the swirler 30.

As the extending direction of the grill rib 420 is the same as or similar to the flow direction of the air for the vortex formation as in the present disclosure, the grill rib 420 is prevented from acting as the passage resistance of the air for the vortex formation, thereby improving a discharge performance in the discharge passage 440. When the discharge performance in the discharge passage 440 is improved as described above, not only the vortex formation becomes smooth but also a suction performance may be improved.

Hereinafter, an operation of the ventilation apparatus 20 will be described.

FIG. 6 illustrates a flow of air generated during an operation of a ventilation apparatus according to a first embodiment of the present disclosure.

Referring to FIGS. 1 to 6, when an operation command of the ventilation apparatus 20 is input, the driving motor 50 and the suction fan 14 are turned on. When the suction fan 14 is turned on, a suction force acts on the flow hole 211, and the swirler 30 rotates in one direction.

When the swirler 30 rotates in one direction, the blade 320 of the swirler 30 pushes the contaminated air flowing toward the through hole 330 of the rotating plate 310 outwardly of the rotating plate 310 in the radial direction.

Further, when the contaminated air passes through the flow hole 211 of the case 21, not only the contaminated air passing through the flow hole 211 but also the surrounding air also tries to pass through the flow hole 211. The vortex is formed below the rotating plate 310 by thus like flow of the air.

In the present embodiment, as the flow guide 22 of the case 21 guides the air (the air for forming the vortex) flowing in the radial direction of the swirler 30 downwardly, the vortex may be effectively formed.

In addition, since the extending direction of the grill rib 420 is the same as or similar to the flow direction of the air for the vortex formation, the air for the vortex formation may smoothly pass through the discharge passage 440 of the grill member 400, thereby improving the discharge performance and the suction performance.

FIG. 7 is a plan view of a grill member according to a second embodiment of the present disclosure.

The present embodiment is identical to the first embodiment in other portions but differs in a form of the grill member. Therefore, only the characteristic portion of the present embodiment will be described below.

Referring to FIG. 7, a grill member 401 according to a second embodiment of the present disclosure may include an outer frame 410 that is fixed to the case 21. The outer frame 410 may be formed in a ring shape, but is not limited thereto, and may have a diameter larger than the diameter of the flow hole 211 of the case 21.

The grill member 401 may further include an inner frame 414 positioned in an inner region formed by the outer frame 410. The inner frame 414 may be formed in a ring shape or a disc shape, but is not limited thereto.

The grill member 401 may include a plurality of grill ribs 422 extended in a circular manner positioned between the outer frame 410 and the inner frame 414 and a support rib 430 for connecting two adjacent grill ribs 422 in the radial direction.

In another respect, the grill member 401 may include a plurality of support ribs 430 connecting the outer frame 410 and the inner frame 414 in the radial direction and a plurality of arc-shaped grill ribs 422, each of which connecting the two adjacent support ribs 430.

In any case, each of the plurality of grill ribs 422 has a rounded shape. Further, a discharge passage 440 and a suction passage 442 are defined in the grill member 401 by the plurality of spaced grill ribs 422.

In this connection, some of the plurality of grill ribs 422 define the discharge passage 440 and the others define the suction passage 442.

The filter 500 may be disposed to partially or entirely cover the suction passage 442.

As described above, the contaminated air passes through the suction passage 442, and a portion of the air that has passed through the suction passage 442 passes through the discharge passage 440.

Also in the present embodiment, the plurality of grill ribs 422 defining the discharge passage 440 extend in a direction same as or similar to the flowing direction of the air for the vortex formation. Thus, the plurality of grill ribs 422 are prevented from acting as the passage resistance of the air, thereby improving a discharge performance and a suction performance of the air through the grill member 401.

FIG. 8 is a plan view of a grill member according to a third embodiment of the present disclosure.

The present embodiment is identical to the first embodiment in other portions but differs in a form of the grill member. Therefore, only the characteristic portion of the present embodiment will be described below.

Referring to FIG. 8, a grill member 402 according to a third embodiment of the present disclosure may include an outer frame 410. The outer frame 410 may be formed in a ring shape, but is not limited thereto, and may have a diameter larger than the diameter of the flow hole 211 of the case 21.

The grill member 402 may further include an inner frame 416 positioned in an inner region formed by the outer frame 410. The inner frame 416 may be formed in a ring shape or a disc shape, but is not limited thereto.

The grill member 402 may include a plurality of first grill ribs 423 of a circular shape positioned between the outer frame 410 and the inner frame 416 and a second grill rib 426 positioned inside a region formed by the inner frame 416.

The second grill rib 426 may be formed in a lattice shape. Further, the plurality of first grill ribs 423 may be connected to each other by a support rib 432.

In another respect, the grill member 402 may include a plurality of support ribs 432 connecting the outer frame 410 and the inner frame 416 in the radial direction, the plurality of arc-shaped first grill ribs 423 connecting two adjacent support ribs 432, and the second grill rib 426 positioned inside the region defined by the inner frame 416. Also in this case, the second grill ribs 426 may be formed in the lattice form.

In any case, the plurality of first grill ribs 423 define a discharge passage 440 and the second grill rib 426 defines a suction passage 442. Further, the filter 500 may partially or entirely cover the suction passage 442.

Also in the present embodiment, the first grill ribs 423 defining the discharge passage 440 extend in a direction same as or similar to the flowing direction of the air for the vortex formation. Thus, the plurality of grill ribs 426 are prevented from acting as the passage resistance of the air, thereby improving a discharge performance and a suction performance of the air through the grill member 402.

In summary of the present embodiment, in the grill member 402, the first grill rib 423 defining the discharge passage 440 and the second grill rib 426 defining the suction passage 442 may have different shapes or may have the same shape but different configurations. In addition, at least the first grill rib 423 defining the discharge passage 440 may be rounded to improve the discharge performance.

In this connection, since the air passes through the suction passage 442 in the vertical direction, there is no possibility that the suction performance is lowered even when the second grill rib 426 defining the suction passage 442 is not rounded.

FIG. 9 is a plan view of a grill member according to a fourth embodiment of the present disclosure.

The present embodiment is identical to the first embodiment in other portions but differs in a form of the grill member. Therefore, only the characteristic portion of the present embodiment will be described below.

Referring to FIG. 9, a grill member 403 according to a fourth embodiment of the present disclosure may include an outer frame 410 that is fixed to the case 21. The outer frame 410 may be formed in a ring shape, but is not limited thereto, and may have a diameter larger than the diameter of the flow hole 211 of the case 21.

The grill member 403 may further include an inner frame 416 positioned in an inner region defined by the outer frame 410. The inner frame 416 may be formed in a ring shape or a disc shape, but is not limited thereto.

The grill member 403 may include a plurality of grill ribs 417 for defining a discharge passage 440 and a suction passage 442.

In this connection, a plurality of grill ribs 417 may include a plurality of first grill ribs 417*a*, each of which connecting two points of the outer frame 410, a plurality of second grill ribs 417*b*, each of which connecting the outer frame 410 and the inner frame 416, and a plurality of third grill ribs 417*c*, each of which connecting two points of the inner frame 416.

Further, each of the plurality of third grill ribs 417*c* connecting the two points of the inner frame 416 defines a suction passage 442. In addition, each of the plurality of first and second grill ribs 417*a* and 417*b* positioned between the inner frame 416 and the outer frame 410 defines a discharge passage 440.

In this embodiment, since the plurality of grill ribs 417 are not rounded but arranged in parallel, a discharge performance of the grill member 403 is somewhat lower than that of the previous embodiment, but is advantageous in that it is easy to manufacture.

Further, the first grill rib 417*a* of the plurality of grill ribs 417 is in a straight line shape connecting the two points of the outer frame 410 and is in a direction similar to the flow direction of the air flowing in a spiral manner, thereby improving a discharge performance.

FIG. 10 is a plan view of a grill member according to a fifth embodiment of the present disclosure.

The present embodiment is identical to the first embodiment in other portions but differs in a form of the grill member. Therefore, only the characteristic portion of the present embodiment will be described below.

Referring to FIG. 10, a grill member 404 according to a fifth embodiment of the present disclosure may include an outer frame 410 that is fixed to the case 21. The outer frame 410 may be formed in a ring shape, but is not limited thereto.

The grill member 404 may include a plurality of support ribs 418*a*, 418*b*, and 418*c* extending from an inner region defined by the outer frame 410 toward a central portion.

The plurality of support ribs 418*a*, 418*b*, and 418*c* may be arranged such that two support ribs form 120 degrees, but are not limited thereto.

The grill member 404 may include a plurality of grill ribs for defining a discharge passage 440 and a suction passage 442.

The plurality of grill ribs may include a plurality of first grill ribs 429*a*, each of which connecting two points of the outer frame 410 and a plurality of second grill ribs 418*b*, each of which connecting two adjacent support ribs 418*a* 418*b*, and 418*c*.

At least some of the plurality of first grill ribs 429*a* may define the discharge passage 440 and at least some of the plurality of second grill ribs 429*b* may define the suction passage 442.

Each of the grill ribs 429*a* and 429*b* has a straight line shape. In the present embodiment, a line connecting the second grill ribs 429*b* with each other may be arranged in a triangular shape when the grill member 404 is viewed as a whole.

According to the present disclosure, the first grill rib 429*a* of the plurality of grill ribs is in a straight line shape connecting the two points of the outer frame 410 and is in a direction similar to the flow direction of the air flowing in a spiral manner, thereby improving a discharge performance.

FIG. 11 is a plan view of a grill member according to a sixth embodiment of the present disclosure.

The present embodiment is identical to the first embodiment in other portions but differs in a form of the grill member. Therefore, only the characteristic portion of the present embodiment will be described below.

Referring to FIG. 11, a grill member 405 according to a sixth embodiment of the present disclosure may include an outer frame 410 that is fixed to the case 21. The outer frame 410 may be formed in a ring shape, but is not limited thereto.

The grill member 405 may include a plurality of support ribs 434 extending from an inner region formed by the outer frame 410 toward a central portion.

The plurality of support ribs 434 may be arranged such that two adjacent support ribs form 90 degrees, but are not limited thereto.

The grill member 405 may include a plurality of grill ribs for defining a discharge passage 440 and a suction passage 442.

The plurality of grill ribs may include a plurality of first grill ribs 427*a*, each of which connecting two points of the outer frame 410 and a plurality of second grill ribs 427*b*, each of which connecting two adjacent support ribs 434.

At least some of the plurality of first grill ribs 427*a* may define the discharge passage 440 and at least some of the plurality of second grill ribs 427*b* may define the suction passage 442.

Each of the grill ribs 427*a* and 427*b* has a straight line shape. In the present embodiment, a line connecting the second grill ribs 427*b* with each other may be arranged in a square shape or a rectangular shape when the grill member 405 is viewed as a whole.

According to the present disclosure, the first grill rib 427*a* of the plurality of grill ribs is in a straight line shape connecting the two points of the outer frame 410 and is in a direction similar to the flow direction of the air flowing in a spiral manner, thereby improving a discharge performance.

FIG. 12 illustrates a ventilation apparatus according to a seventh embodiment of the present disclosure.

Referring to FIG. 12, a ventilation apparatus 70 of the present embodiment may be a hood that is installed independently of the cooking device 2 in the kitchen.

The ventilation apparatus 70 may be installed on the wall W or at a position adjacent to the wall W in the kitchen and furniture pieces 3 and 4 may be installed around the ventilation apparatus 70.

Further, the cooking device 2 may be located below the ventilation apparatus 70.

The ventilation apparatus 70 may generally include a first casing 72 and a second casing 74. The suction fan (see 14 in FIG. 1) described in the first embodiment may be positioned in the first casing 72 and the vortex forming apparatus described in the first embodiment may be positioned in the second casing 74.

Further, the grill member described in the first to sixth embodiments may be installed on a bottom surface of the second casing 74.

FIG. 13 is a perspective view illustrating a ventilation apparatus according to an eighth embodiment of the present disclosure. In addition, FIG. 14 is a bottom perspective view of a ventilation apparatus illustrated in FIG. 13. In addition, FIG. 15 is a cross-sectional view taken along a line "A-A" in FIG. 13.

Referring to FIGS. 13 to 15, a ventilation apparatus 80 according to the present embodiment includes a main body 800 (or a case) and a blower 900.

The main body 800 forms an outer surface of the ventilation apparatus 80 according to the present embodiment and may include a lower housing 810 and an upper housing 820.

The lower housing 810 is disposed at a lower portion of the main body 800 and a space through which air suctioned through air intakes 810*a* and 810*b* (or flow holes) flows is defined in the lower housing 810. In the present embodiment, the lower housing 810 is illustrated as being formed in a flat box shape having a front and rear directional length and a lateral width thereof larger than a vertical level thereof.

The air intakes 810*a* and 810*b* are defined in a bottom surface of the lower housing 810 formed as described above. The air intakes 810*a* and 810*b* are defined to pass through the bottom surface of the lower housing 810 to define passages for suctioning outside air into the space inside the lower housing 810.

In the present embodiment, the air intakes 810*a* and 810*b* may include a main air intake 810*a* and an auxiliary air intake 810*b*.

According to this, the main air intake 810*a* is disposed at a widthwise center of the lower housing 810 to define a passage for suctioning the outside air into the space inside the lower housing 810 at the widthwise center of the lower housing 810.

In addition, each auxiliary air intake 810*b* is disposed at each of both sides in the width direction of the lower housing 810. Each auxiliary air intake 810*b* is disposed at a predetermined distance from the main air intake 810*a* along the width direction of the lower housing 810 to define a path, along which the outside air is suctioned into the space in the lower housing 810, at each of the both sides in the width direction of the lower housing 810.

As a result, the ventilation apparatus 80 of the present embodiment may extend, in the width direction thereof, regions at which the air may be suctioned not only as far as to regions around the main air intake 810*a* but also as far as to regions around the auxiliary air intake 810*b*. Therefore, contaminants in a larger region may be efficiently collected and discharged.

According to the present embodiment, the lower housing 810 may be provided in a shape in which a suction duct 811 and a lower panel 815 are coupled to each other in a vertical direction.

The suction duct 811 is in a form of a flat box with an open bottom surface. The lower panel 815 is coupled to the open bottom surface of the suction duct 811. In addition, a space having upper and side portions thereof surrounded by the suction duct 811 and a lower portion thereof surrounded by the lower panel 815 is defined in the suction duct 811. Further, the upper housing 820 is connected to a top surface of the suction duct 811. In addition, a connection between the suction duct 811 and the upper housing 820 is opened such that inside of the housing 810 and inside of the upper housing 820 are connected to each other.

The lower panel 815 is coupled to an open lower portion of the suction duct 811 to form the bottom surface of the lower housing 810. The lower panel 815 has a width directional length shorter than that of the suction duct 811, and is installed on the bottom surface of the suction duct 811 such that a widthwise center thereof is positioned at a widthwise center of the suction duct 811. Thereby, each gap is defined between each widthwise end of the lower panel 815 and each widthwise end of the suction duct 811. In addition, each gap thus defined in each of both sides in width direction of the lower housing 810 may be provided as the auxiliary air intake 810*b*.

A depression 816 is defined in the lower panel 815. The depression 816 is defined in a substantially central portion of the lower panel 815 in a form depressed inwardly of the lower housing 810. Further, the main air intake 810*a* is defined to pass through this depression 816 in the vertical direction.

The upper housing 820 is disposed at an upper portion of the main body 800 and a receiving space is defined in the upper housing 820. In the present embodiment, the upper housing 820 is illustrated as being formed in a box shape with an open bottom surface. The open bottom surface of the upper housing 820 is connected to an open top surface of the lower housing 810, so that the air suctioned through the lower housing 810 may flow into the receiving space inside the upper housing 820.

Further, the blower 900 is installed in the receiving space inside the upper housing 820. The blower 900 is installed inside the upper housing 820, that is, the receiving space inside the main body 800 to form an air flow for suctioning the outside air into the main body 800 through the air intakes 810*a* and 810*b*.

In addition, the ventilation apparatus 80 in the present embodiment may further include a vortex forming apparatus 1000. The vortex forming apparatus 1000 is installed inside the main body 800, more specifically inside the lower housing 810 to form a vortex in regions around the air intakes 810*a* and 810*b* so as to induce the suction of the outside air into the main body 800 through the air intakes 810*a* and 810*b*.

FIG. 16 is a cross-sectional view illustrating an internal structure of a blower illustrated in FIG. 15.

Referring to FIGS. 15 and 16, the blower 900 may include a scroll housing 910, an impeller 920, and a first driving portion 930.

The scroll housing 910 forms an outer surface of the blower 900. In addition, a suction hole 910*a* is defined in a side portion of the scroll housing 910 to define a path through which the outside air is suctioned into the impeller 920. Each suction hole 910*a* is defined in each of both side portions of the scroll housing 910. Each suction hole 910*a* serves as a suction path through which the blower 900 suctions the air through each of both side portions thereof.

In the present embodiment, the suction housing 910 is illustrated as being formed in a shape including a horizontal cylindrical shape in which both side portions thereof are opened. Further, each open both side portions of the scroll housing 910 is provided as the suction hole 910*a*.

A receiving space for receiving the impeller 920 is defined in the scroll housing 910. An inner peripheral surface of the scroll housing 910 facing the receiving space is formed as a curved surface surrounding an outer peripheral surface of the impeller 920.

A discharge portion 915 is provided above the scroll housing 910. A discharge port connected to the receiving space inside the scroll housing 910 is defined in the discharge portion 915. This discharge port defines a path through which the air suctioned into the receiving space in which the impeller 920 is received is discharged to the outside of the blower 900.

The discharge portion 915 may pass through the upper housing 820 in an upward direction and protrude upwardly of the main body 800. Further, the discharge portion 915 may be disposed on an outer surface of the main body 900 and connected to an external duct (not shown). Thus, the air suctioned into the receiving space in which the impeller 920 is received may be discharged to the outside through the discharge port defined in the discharge portion 915 and the external duct connected to the discharge port.

The impeller 920 is provided to be rotatable about a shaft extending in a lateral direction. A space through which the air suctioned through both side portions of the impeller 920 is inflowed is defined in this impeller 920.

The impeller 920 includes a hub 921 having a rotation shaft connection portion to which a rotation shaft of a motor provided in a first driving portion 930 is connected. The impeller 920 connected to the rotation shaft of the motor provided in the first driving portion 930 via the hub 921 may be rotated about the shaft extending in the lateral direction.

In addition, the impeller 920 may include a first blade 923 formed on one side of the hub 921, i.e., on a left side surface of the hub 921 and a second blade 925 formed on the other side surface of the hub 921, i.e., on a right side of the hub 921.

The impeller 920 may include a turbo fan, a sirocco fan, or the like. When the impeller 920 includes the turbo fan, the first blade 923 and the second blade 925 may be in a form of a blade with a curved rear portion.

When the impeller 920 includes the sirocco fan, the first blade 923 and the second blade 925 may be respectively formed in a multi-blade shape of the sirocco fan.

The first blade 923 may be installed to be positioned between the left side surface of the hub 921 and a left side surface of the scroll housing 910 to be spaced apart from the left side surface of the scroll housing 910 to some extent. The second blade 925 may be installed to be positioned between the right side surface of the hub 921 and a right side surface of the scroll housing 910 to be spaced apart from the right side surface of the scroll housing 910 to some extent.

The first driving portion 930 is provided to provide power for rotating the impeller 920. This first driving portion 930 may include a rotor 931, which is a rotating portion of the motor, a stator 933, which is a stationary portion of the motor, a motor case 935, which forms an outer surface of the motor and receives the rotor 931 and the stator 933 therein, and a shaft 937 rotating together with the rotor 931. A connection between the first driving portion 930 and the impeller 920 is accomplished by a coupling between the shaft 937 and the hub 921. This causes the power generated from the first driving portion 930 to be transmitted to the impeller 920 via the shaft 937 and the hub 921, thereby rotating the impeller 920.

The blower 900 having the above components may be operated in one of a plurality of modes distinguished from each other based on an air volume suctioned by the blower 900.

For example, the blower 900 may be operated in a high air volume mode that generates, with a high level of the air volume, an airflow that suctions the outside air into the main body 800 through the air intakes 810*a* and 810*b*. Alternatively, the blower 900 may be operated in a low air volume mode that generates suction airflow having a flow speed that is relatively low compared with the high air volume mode.

Whether the blower 900 is operated in the high air volume mode or in the low air volume mode may be determined by a rotational speed of the first driving portion 930 that rotates the impeller 920. That is, as the first driving portion 930 is operated to rotate the impeller 920 at a high speed, the blower 900 may be operated in the high air volume mode. On the other hand, as the first driving portion 930 is operated to rotate the impeller 920 at a relatively low speed, the blower 900 may be operated in the low air volume mode.

When the blower 900 is operated in the high air volume mode, a suction airflow having a high flow speed may be formed such that contaminants farther away may be suctioned, thereby increasing a collection efficiency for the contaminant of the ventilation apparatus 80.

When the blower 900 is operated in the low air volume mode, the speed of the suction airflow is lowered compared to that of the high air volume mode. Thus, the collection efficiency for the contaminant of the ventilation apparatus 1 is lowered, but a noise and a power consumption resulted from the driving of the blower 900 may be reduced.

According to the present embodiment, when the blower 900 is operated in the low air volume mode, the operation of the vortex forming apparatus 1000 may be performed simultaneously. The vortex forming apparatus 1000 generates a vortex in a form of a doughnut around the air intakes 810*a* and 810*b*, more particularly around the main air intake 810*a* to extend the suction regions of the ventilation apparatus. Therefore, even when the speed of the suction airflow is low, the suction of the contaminant and the air may be performed more efficiently.

FIG. 17 is a perspective view of a portion of a vortex forming apparatus illustrated in FIG. 15. FIG. 18 is a front view of a vortex forming apparatus illustrated in FIG. 17.

Referring to FIGS. 15, 17, and 18, the vortex forming apparatus 1000 may include a swirler 1010, a second driving portion 1020, and a flow guide 1030.

The swirler 1010 is disposed on the air intakes 810*a* and 810*b*, more particularly on the main air intake 810*a* and may be rotated to form the vortex around the main air intake 810*a*. The swirler 1010 may include a rotating plate 1011 and a blade portion 1015.

The rotating plate 1011 is disposed to be positioned lower than the main air intake 810*a*, and to be disposed in a region surrounded by the depression 826 of the lower panel 825. A central portion of the rotating plate 1011 is connected to a shaft of the second driving portion 1020 and is rotatable around the shaft, that is, around a rotation shaft extending in the vertical direction.

A coupling portion 1012 for coupling the rotating plate 1011 with the shaft of the second driving portion 1020 may be provided at the central portion of the rotating plate 1011. Further, a through hole through which the air suctioned into the main air intake 810*a* is defined in the rotating plate 1011.

In the present embodiment, the rotating plate 1011 is illustrated as being formed in a form of a circular ring. According to this, the through hole of the rotating plate 1011 is defined to pass through between an outer peripheral surface of the rotating plate 1011 and the coupling portion 1012. In addition, the coupling portion 1012 is disposed at the central portion of the rotating plate 1011, a position surrounded by the through hole and is fixed on the rotating plate 1011 by a connection portion 1013 intersecting between the outer peripheral surface of the rotating plate 1011 and the coupling portion 1012.

The blade portion 1015 surrounds an outer circumferential portion of the rotating plate 1011. The blade portion 1015 may include a flat portion 1016 and blades 1017 and 1018.

The flat portion 1016 is formed to be flush with the rotating plate 1011. The flat portion 1016 may include a plurality of flat portions arranged along the rotating direction of the rotating plate 1011 to surround the outer circumferential portion of the rotating plate 1011.

A passing hole portion 1019 is defined between two adjacent flat portions 1016. The passing hole portion 1019 is defined to pass through between two flat portions 1016, thereby defining a path passing through the blade portion 1015 along the extending direction of the rotation shaft that rotates the rotating plate 1011, that is, along the vertical direction. That is, the flat portion 1016 and the passing hole portion 1019 are alternately arranged at outer circumferential portion of the rotating plate 1011 along the rotating direction of the rotating plate 1011.

The blades 1017 and 1018 protrude from the flat portion 1016 in the extending direction of the rotation shaft, that is, in the downward direction. The blades 1017 and 1018 rotate together with the rotating plate 1011 to push the air outwardly of the rotating plate 1011. The vortex forming apparatus 1000 may generate the vortex around the main air intake 810*a* by an action of such blades 1017 and 1018.

The blades 1017 and 1018 respectively include a plurality of blades 1017 and a plurality of blades 1018 to surround the outer circumferential portion of the rotating plate 1011. That is, the blades 1017 and 1018 extend from both sides of each of the flat portions 1016 respectively. Further, the both sides of each of the flat portions 1016 may be downwardly bent to form the blades 1017 and 1018.

According to the present embodiment, the blades 1017 and 1018 may respectively include a first blade 1017 and a second blade 1018.

The first blade 1017 is disposed on one side of the flat portion 1016 along the rotating direction of the rotating plate 1011 and the second blade 1018 may be disposed on the other side of the flat portion 1016 along the rotating direction of the rotating plate 1011.

That is, said one side of the flat portion 1016 is bent to form the first blade 1017, and the other side of the flat portion 1016 is bent to form the second blade 1018.

Alternatively, each of the plurality of blades 1017 and 1018 may be coupled to the rotating plate 1011.

The vortex forming apparatus 1000 having the swirler 1010 as described above is installed on the main air intake 810*a* through which the air is suctioned. Thus, the flow of the air suctioned through the main air intake 810*a* may affect the operation of the vortex forming apparatus 1000. In addition, the vortex forming apparatus 1000 may affect the flow of the air suctioned through the main air intake 810*a*.

For example, during the operation of the vortex forming apparatus 1000, when a colliding frequency of the air suctioned toward the main air intake 810*a* with the swirler 1010 is high, a rotating speed of the swirler 1010 is lowered because of a resistance resulted from the collision. Therefore, the vortex formation may not be achieved properly, and the suction of the air through the main air intake 810*a* may be interrupted, simultaneously.

In consideration of this, in the vortex forming apparatus 1000 of the present embodiment, the passing hole portion 1019 defining a path passing through the swirler 1010 is defined. According to this, a portion of the air inflowed toward the swirler 1010 is pushed outwardly of the swirler 1010 by the actions of the blades 1017 and 1018 to form the vortex. In addition, the remaining portion passes through the swirler 1010 through the passing hole portion 1019 to flow upwardly of the vortex forming apparatus 1000.

Therefore, the resistance resulted from the collision between the air suctioned toward the main air intake 810*a* and the swirler 1010 is reduced. Accordingly, not only a performance of the vortex forming apparatus 1000 may be further improved, but also the suction of the air through the main air intake 810*a* may be performed more smoothly.

Further, the second driving portion 1020 is provided to provide power to rotate the swirler 1010 and is installed in the main body 800, more specifically, in the second casing 820. This second driving portion 1020 among the components of the vortex forming apparatus 1000 is disposed at an uppermost position. In addition, the second driving portion 1020 may include a motor having a shaft that transmitting a rotational force is extended in a downward direction.

The flow guide 1030 is disposed above the main air intake 810*a* and is disposed on a top surface of the swirler 1010 to surround the swirler 1010. Further, the flow guide 1030 guides the air flowing during the rotating of the swirler 1010 downwardly.

The flow guide 1030 may have a guide surface inclined downwardly and outwardly. For example, the guide surface may include a round surface.

The ventilation apparatus 80 of the present embodiment may further include a filter 1200 and a grill member 1300.

The filter 1200 is provided for filtering the air suctioned into the main body 800 through the main air intake 810*a*.

The grill member 1300 is disposed below the vortex forming apparatus 1000, more specifically, below the swirler 1010 described below. The filter 1200 is detachably installed on this grill member 1300.

In the present embodiment, the grill member 1300 is illustrated as being formed in a form of a grill of a circular plate shape, but the shape of the grill member 1300 is not limited thereto. The grill member 1300 may be in a rectangular plate shape, may be in various shapes corresponding to the shape of the main air intake 810*a*, and may be in various shapes based on a need.

The grill member 1300 may be installed below the vortex forming apparatus 1000 by being coupled with the lower panel 815 of the lower housing 810 to cover a bottom surface of the main air intake 810*a*. As an example, the grill member 1300 may be coupled to the lower panel 815 is a bolting manner.

The filter 1200 and the grill member 1300 thus installed not only provide a function of filtering the air suctioned through the main air intake 810*a* but also provide a function of improving safety of the apparatus and the user by blocking an external object, for example, a user's hand or cooking utensil from accessing the swirler 1010 while the swirler 1010 is rotating.

FIGS. 19 to 21 illustrate a manufacturing process of a vortex forming apparatus illustrated in FIG. 18.

Referring to FIGS. 18 and 19, a rotating plate 1011 and a blade portion 1015 are formed by a single disk prepared for manufacturing the swirler 1010. In this disk, a radially inner portion of the disk is the rotating plate 1011 and a radially outer portion of the disk is the blade portion 1015. At this time, the blade portion 1015 is formed with only a flat portion 1016, which is flush with the rotating plate 1011.

In this state, as shown in FIGS. 18 and 20, the blade portion 1015 is cut to be divided into a plurality of sections along a circumferential direction of the disk to form a plurality of flat portions 1016 at the blade portion 1015.

Then, as shown in FIGS. 18 and 21, a first blade 1017 and a second blade 1018 are respectively formed on both sides of each flat portion 1016 when both sides of each of the plurality of flat portions 1016 are bent downwardly.

For example, after between two adjacent flat portions 1016 is cut, a cut end of one of the two adjacent flat portions 1016 is bent in an extending direction of a rotation shat, that is in a downward direction to form the first blade 1017. Further, the other cut end is bent in the downward direction to form the second blade 1018.

Thereby, the first blade 1017 and the second blade 1018 are respectively formed at left and right side of each flat portion 1016. The flat portion 1016 with the first blade 1017 and the second blade 1018 on the both sides thereof includes a plurality of flat portions arranged at an outer circumferential portion of the rotating plate 1011 along the circumferential direction of the rotating plate 1011 to form the blade portion 1015.

A passing hole portion 1019 is defined between the regions thus bent to form the first blade 1017 and the second blade 1018, that is, between the two flat portions 1016 adjacent to each other.

That is, due to one operation of bending the both cut sides of the flat portion 1016 in the downward direction, the first blade 1017 and the second blade 1018 may be formed on the both sides of the flat portion 1016 and the passing hole portion 1019 may be defined between the two adjacent flat portions 1016, simultaneously. At this time, the passing hole portion 1019 is defined between the first blade 1017 of one of the two adjacent flat portions 1016 and the second blade 1018 of the other of the two adjacent flat portions 1016.

Since the blade portion 1015 is formed as described above, a fixing structure and a fixing operation for fixing the blade portion 1015 to the rotating plate 1011 are not required, so that a cost for manufacturing the swirler 1010 and a working time may be reduced.

In addition, since the formation of the blade portion 1015 is achieved by cutting a portion of the rotating plate 1011, the fixing between the rotating plate 1011 and the blade portion 1015 is not necessary. Therefore, a range of a restriction based on a strength of a material for manufacturing the swirler 1010 is reduced, thereby reducing the cost required for the manufacturing of the swirler 1010.

FIG. 22 illustrates a flow of air in a vortex forming apparatus illustrated in FIG. 18.

Hereinafter, an action and an effect of a ventilation apparatus according to the present embodiment and of a vortex forming apparatus provided to the ventilation apparatus will be described with reference to FIGS. 15 to 17, and 22.

Referring to FIGS. 15 and 16, the operation of the blower 900 is started when the operation of the ventilation apparatus 80 starts and then a suction airflow for suctioning the air outside of the ventilation apparatus 80 toward the blower 900 installed in the main body 800 is generated.

The suction airflow thus generated acts on the outside air, which is subjected to be suctioned through the air intakes 801 and 810*b* formed at the lower portion of the main body 800. The outside air around the air intakes 810*a* and 810*b* passes through the air intakes 810*a* and 810*b* by the suction airflow acting in this manner to be suctioned into the main body 800.

Further, the air thus suctioned into the main body 800 and the contaminants suctioned together with the air are suctioned into the blower 900 through the both sides of the blower 900 and then discharged to the outside through the discharge portion 915 opened upwardly of the blower 900 and the external duct connected thereto.

When the blower 900 is operated in the high air volume mode, the suction airflow having the high flow speed may be formed such that contaminants farther away may be suctioned, thereby increasing the collection efficiency for the contaminant of the ventilation apparatus 80.

On the other hand, when the blower 900 is operated in the low air volume mode, the speed of the suction airflow is lowered compared to that of the high air volume mode. Thus, the collection efficiency for the contaminant of the ventilation apparatus 1 is lowered, but the noise and the power consumption resulted from the driving of the blower 900 may be reduced.

According to the present embodiment, when the blower 900 is operated in the low air volume mode, the operation of the vortex forming apparatus 1000 may be performed simultaneously. The vortex forming apparatus 1000 generates the vortex around the air intakes 810*a* and 810*b*, more particularly around the main air intake 810*a* to extend the suction regions of the ventilation apparatus. Therefore, even when the speed of the suction airflow is low, the suction of the contaminant and the air may be performed more efficiently.

The action of the vortex forming apparatus 1000 is achieved such that the blades 1017 and 1018 rotating together with the rotating plate 1011 that is rotated by the power provided by the second driving portion 1010 push out the air flowing toward the main air intake 810*a* in an outward direction of the rotating plate 1011, and the air thus pushed out forms the vortex in the shape such as the doughnut shape.

The vortex forming apparatus 1000 as described above is installed on the main air intake 810*a* through which the air is suctioned. Thus, the flow of the air suctioned through the main air intake 810*a* may affect the operation of the vortex forming apparatus 1000. In addition, the vortex forming apparatus 1000 may affect the flow of the air suctioned through the main air intake 810*a*.

For example, during the operation of the vortex forming apparatus 1000, when a colliding frequency of the air suctioned toward the main air intake 810*a* with the rotating plate 1011 is high, rotating speeds of the rotating plate 1011 and the blades 1017 and 1018 are lowered because of a resistance resulted from the collision. Therefore, the vortex formation may not be achieved properly, and the suction of the air through the main air intake 810*a* may be interrupted, simultaneously.

In consideration of this, in the vortex forming apparatus 1000 of the present embodiment, the passing hole portion 1019 defining a path passing through the blade portion 1015 is defined as shown in FIGS. 17 and 22. According to this, a portion of the air inflowed toward the blade portion 1015 is pushed outwardly of the rotating plate 1011 by the actions of the blades 1017 and 1018 to form the vortex. In addition, the remaining portion passes through the blade portion 1015 through the passing hole portion 1019 to flow upwardly of the swirler 1010.

Therefore, the resistance resulted from the collision between the air suctioned toward the main air intake 810*a* and the rotating plate 1011 is reduced. Accordingly, not only the performance of the vortex forming apparatus 1000 may be further improved, but also the suction of the air through the main air intake 810*a* may be performed more smoothly.

The ventilation apparatus having the configuration as described above and the vortex forming apparatus included thereto are merely preferred embodiments of the present disclosure, and there may be various embodiments that may replace the above preferred embodiments.

FIG. 23 is a perspective view illustrating another example of a vortex forming apparatus illustrated in FIG. 17. In addition, FIG. 24 is a front view of a vortex forming apparatus illustrated in FIG. 23. In addition, FIG. 25 illustrates a flow of air in a vortex forming apparatus illustrated in FIG. 24.

Hereinafter, other embodiments of the present disclosure will be described with reference to FIGS. 23 to 25.

In this connection, the same reference numerals as those shown in the previous drawings denote the same members having the same function, thus, a duplicate description will be omitted herein.

First, referring to FIGS. 23 and 24, a vortex forming apparatus 1100 according to another embodiment of the present disclosure has a blade portion 1115 of a swirler 1110 having a different shape as compared to the vortex forming apparatus (1000; see FIG. 15) of the previous embodiment.

That is, blades 1117 and 1118 of the blade portion 1115 include a first blade 1117 and a second blade 1118, The first blade 1117 and the second blade 1118 are formed to protrude downwardly at an acute angle or an obtuse angle with a flat portion 1016 without being perpendicular to the flat portion 1016. This is compared to the shape in which the blades 1017 and 1018 (see FIG. 17) in the above-described embodiment are bent to be perpendicular to the flat portion 1016.

According to the present embodiment, the first blade 1117 and the second blade 1118 are formed to be bent in a manner to be inclined downwardly of the flat portion 1016, and are formed to form an inclined surface inclined in a rotating direction of the rotating plate 1011 about a connection with the flat portion 1016.

For example, when the rotating plate 1011 rotates from left to right when viewed from a front, the first blade 1117 located on the left side of the flat portion 1016 protrudes downwardly of the flat portion 1016 to form the acute angle with the flat portion 1016 and the second blade 1118 located on the right side of the flat portion 1016 protrudes downwardly of the flat portion 1016 to form the obtuse angle with the flat portion 1016.

For example, when the rotating plate 1011 rotates from right to left when viewed from the front, the first blade 1117 located on the left side of the flat portion 1016 may protrude downwardly of the flat portion 1016 to form the obtuse angle with the flat portion 1016 and the second blade 1118 located on the right side of the flat portion 1016 may protrude downwardly of the flat portion 1016 to form the acute angle with the flat portion 1016.

As the shape of the blade portion 1115 is achieved in the above-described manner, the vortex forming apparatus 1100 of the present embodiment may use flow speed energy of the air inflowed to the blade portion 1115 to induce an efficient rotation of the rotating plate 1011 and the blade portion 1115.

According to the present embodiment, a portion of the air inflowed to the blade portion 1115 of the vortex forming apparatus 1100 is pushed outwardly of the rotating plate 1011 by the action of the blades 1117 and 1118 to form the vortex, as shown in FIGS. 23 and 25. In addition, the other portion thereof passes through the blade portion 1015 through a passing hole portion 1019 to flow upwardly of the vortex forming apparatus 1100.

At this time, a portion of the air that has passed the blade portion 1015 through the passing hole portion 1019 collides with the inclined surface formed by the first blade 1117 or the second blade 1118 protruded to form the acute angle with the flat portion 1016, and then passes through the blade portion 1115 through the passing hole portion 1019. Likewise, the flow speed energy of the air colliding with the inclined plane formed by the first blade 1117 or the second blade 1118 may act as an element for promoting the rotation of the rotating plate 1011 and the blade portion 1115.

Further, a portion of the air pushed outwardly of the rotating plate 1011 by the action of the blades 1117 and 1118 collides with the inclined surface formed by the first blade 1117 or the second blade 1118 protruded to form the obtuse angle with the flat portion 1016 before being pushed out by the blades 1117 and 1118. Likewise, the flow speed energy of the air colliding with the inclined surface formed by the first blade 1117 or the second blade 1118 may also act as the element for promoting the rotation of the rotating plate 1011 and the blade portion 1115.

As described above, the vortex forming apparatus 1100 of the present embodiment may use the flow speed energy of the air inflowed to the blade portion 1115 to efficiently increase the rotation speeds of the rotating plate 1011 and the blade portion 1115 such that power consumption required for the driving may be reduced, thereby reducing the noise generated in the driving process.

FIG. 26 is a perspective view illustrating a grill member and a filter illustrated in FIG. 15. FIG. 27 is a cross-sectional view taken along a line "B-B" in FIG. 26. In addition, FIG. 28 is a bottom view illustrating a state in which a grill member is coupled to a main body. In addition, FIGS. 29 and 30 are cross-sectional views illustrating a state in which a filter is installed on a grill member.

First, referring to FIGS. 26 to 28, a filter 1200 is disposed at air intakes 810*a* and 810*b*, and more particularly, at a main air intake 810*a*. This filter 1200 is provided to filter air suctioned into a main body 800 through the main air intake 810*a*.

The filter 1200 may be formed in a circular plate shape, may be formed in various shapes corresponding to shapes of the main air intake 810*a*, or may be formed in various shapes as needed.

In the present embodiment, the filter 1200 is exemplified as being formed in a circular plate shape, which is flat in a vertical direction, and is being formed of a flexible material that may be bent in the vertical direction.

The grill member 1300 is disposed below a swirler 1010, and the filter 1200 is detachably installed on this grill member 1300. This grill member 1300 serves as a blocking wall for blocking user's fingers or other foreign matters from approaching the swirler (1010; see FIG. 15) and serves as a support frame for an installation of the filter 1200, simultaneously.

In the present embodiment, the grill member 1300 is exemplified as being in the form of a grill of a circular plate shape. This grill member 1300 may be coupled to a lower panel 815 of a lower housing 810 to cover a bottom surface of the main air intake 810*a* and may be installed below the vortex forming apparatus 1000.

The grill member 1300 may include an outer frame member (or an outer frame) 1330, a suction passage for suctioning air, and a grill rib for defining a discharge passage for discharging the air.

The grill rib may include a concentric member 1320. Further, the grill member may further include a radial member 1310 connecting the concentric members 1320.

The radial member (or a support rib) 1310 is provided in a form in which a plurality of ribs are extended in a radial direction and are being connected to each other. For example, the radial member 1310 may be formed in a "*" shape in which the plurality of ribs are extended in the radial direction and are being connected to each other, and each rib may be formed in a straight rod shape.

The concentric member 1320 has a plurality of ribs arranged concentrically and being connected to the radial member 1310. For example, the concentric member 1320 may be formed in a shape of "◎" in which the plurality of ribs are arranged concentrically. In this connection, the ribs may be formed in a circular ring shape having a different size from each other.

The ribs forming the concentric member 1320 are arranged to be spaced apart from each other along radial directions thereof. Accordingly, a through hole 1321 is defined each of between the plurality of ribs forming the concentric member 1320. The through hole 1321 thus defined defines a path through which the air below the main air intake 810*a* passes through the grill member 1300 to inflow the main body 800 through the main air intake 810*a*.

In this connection, a plurality of through holes 1321 may be arranged in a concentric circle shape like the plurality of ribs forming the concentric member 1320. As a result, the plurality of ribs and the through holes 1321 are alternately arranged in the radial direction of the grill member 1300 in the concentric member 1320.

In addition, each of the ribs forming the concentric member 1320 is connected to each of the ribs constituting the radial member 1310. In the present embodiment, the radial member 1310 and the concentric member 1320 are illustrated as being integrally formed.

The outer frame member 1330 (or the outer frame) is disposed outwardly of the concentric member 1320 to form an outermost frame of the grill member 1300. This outer frame member 1330 may be formed in a form of a circular ring having a diameter larger than that of the concentric member 1320 and may be connected to outer ends of the ribs forming the radial member 1310 to be coupled to the radial member 1310 and the concentric 1320.

In the present embodiment, the radial member 1310, the concentric member 1320, and the outer frame member 1330 are exemplified to being integrally formed to form one grill member 1300. That is, the grill member 1300 of the present embodiment may be manufactured in a manner of integrally forming the radial member 1310, the concentric member 1320, and the outer frame member 1330. Therefore, the grill member 1300 may be easily and quickly manufactured at a low cost and a mass production of the grill member 1300 may be easily applied.

The outer frame member 1330 forms the outermost frame of the grill member 1300 and provides a mating surface of the grill member 1300 and the main body 800 to the outer side of the grill member 1300.

That is, as the grill member 1300 is coupled to the lower panel 815 of the lower housing 810 while the grill member 1300 is covering the bottom surface of the main air intake 810*a*, the coupling between the grill member 1300 and the main body 800 may be achieved below the vortex forming apparatus 1000.

In the present embodiment, the grill member 1300 is exemplified as being coupled to the lower panel 815 in the bolting manner. According to this, the outer frame member 1330 is formed with a fastening hole 1331 defined therein for fastening the main body 800, more specifically, the lower panel 815 of the lower housing 810 to the outer frame member 1330.

A plurality of fastening holes 1331 are arranged in the outer frame member 1330 at predetermined intervals along a circumferential direction of the outer frame member 1330 formed in the circular ring shape. Further, the lower panel 815 may be also provided with the same number of fastening holes as the fastening holes 1331 of the outer frame member 1330 and at the same intervals.

The fastening between the lower housing 810 and the lower panel 815 may be achieved by fastening the fastening member such as a bolt to the fastening hole 1331 of the fastening member in a state in which the grill member 1300 and the lower panel 815 are being in contact with each other such that a position of the fastening hole 1331 of the outer frame member 1330 and the fastening hole of the lower panel 815 are aligned with each other.

In order to ensure a smooth fastening between the outer frame member 1330 and the lower panel 815, it is necessary to align the position of the grill member 1300 such that the fastening hole 631 of the outer frame member 1330 and the fastening hole of the lower panel 815 are aligned with each other.

To this end, an alignment cut 1335 is provided on an outer rim of the outer frame member 1330. The alignment cut 1335 serves to guide an installation position of the grill member 1300 such that the alignment cut 1335 interferes with the main body 800, more specifically, an alignment structure 815*a* provided on the lower panel 815 to allow the fastening hole 1331 to be positioned at a designated position relative to the main body 800, that is, to allow the fastening hole 1331 of the outer frame member 1330 to be positioned at a position at which the fastening hole 1331 is aligned with the fastening hole of the lower panel 815.

In the present embodiment, the outer frame member 1330 is formed in the circular ring shape and the alignment cut 1335 is formed in a shape in which a portion of an outer rim of the outer frame member 1330 is cut away in a straight line shape. In addition, the outer frame member 1330 is exemplified as having a pair of alignment cuts 1335 arranged facing away from each other about a lateral central portion of the grill member 1300.

According to this, the installation position of the grill member 1300 is guided to a position where the pair of alignment cuts 1335 respectively interfere with the alignment structures 815*a* provided on the lower panels 815. At this position, the installation position of the grill member 1300 may be guided to be in the state in which the fastening hole 1331 of the outer frame member 1330 and the fastening hole of the lower panel 815 are aligned with each other.

Likewise, the installation position of the grill member 1300 may be easily and conveniently guided such that the fastening hole 1331 is disposed at the designated position relative to the main body 800. Thus, the installation of the grill member 1300 may be more easily and quickly performed.

The radial member 1310 may be divided into an inner section 1311 and an outer section 1315. The inner section 1311 is a section including the lateral central portion of the radial member 1310 and the outer section 1315 is a section disposed outwardly of the inner section 1311.

In addition, a first connection portion 1313 is formed between the inner section 1311 and the outer section 1315 to connect the inner section 1311 and the outer section 1315 in a stepwise manner in a vertical direction. The first connection portion 1313 connects the inner section 1311 and the outer section 1315 such that the inner section 1311 is positioned higher than the outer section 1315. In the present embodiment, the inner section 1311 and the outer section 1315 are exemplified as being formed in a shape of a bar extending in a lateral direction, that is, in a horizontal direction and the first connection portion 1313 is exemplified as being formed in a shape of a bar extending in a longitudinal direction, that is, a vertical direction.

A step is formed between the inner section 1311 and the outer section 1315 in this manner such that a space surrounded by the inner section 1311 and the first connection portion 1313 is defined in a lower portion of the inner section 1311 in the grill member 1300. In addition, the space defined in the grill member 1300 as described above may be provided as a space for allowing the filter 1200 to be mounted in the grill member 1300.

Further, the inner section 1311 forms a top boundary surface of the filter 1200 mounting space together with the concentric member 1320 connected at the corresponding position. The top boundary surface thus formed not only serves as a blocking wall for blocking user's fingers, other foreign matters, or the like from approaching the swirler 1010 and but also serves as a separation preventing wall for preventing the filter 1200 installed in the filter 1200 mounting space from being separated to an upper portion of the grill member 1300.

Further, a second connection portion 1317 is formed between the outer frame member 1330 and the outer section 1315 to connect the outer section 1315 and the outer frame member 1330 in a stepwise manner in the vertical direction. The second connection portion 1317 connects between the outer section 1315 and the outer frame member 1330 such that the outer section 1315 is positioned lower than the outer frame member 1330. In the present embodiment, the inner section 1311, the outer section 1315, and the outer frame member 1330 are exemplified as being formed in a shape of a bar extending in a lateral direction, that is, in a horizontal direction. In addition, the first connection portion 1313 and the second connection portion 1315 are exemplified as being formed in a shape of a bar extending in a longitudinal direction, that is, a vertical direction.

Preferably, the second connection portion 1317 may have a length that allows the outer frame member 1330 and the inner portion 1311 to be flush with each other. For example, the second connection portion 1317 may have a longitudinal length corresponding to a longitudinal length of the first connection portion 1313. Thus, the outer frame member 1330 and the inner section 1311 may be flush with each other.

When the outer frame member 1330 and the inner section 1311 are flush with each other as described above, the mating surface between the grill member 1300 and the main body 800 provided by the outer frame member 1330 and the filter separation preventing wall may be flush with each other.

That is, the filter separation preventing wall provided by the inner section 1311 of the grill member 1300 may not be disposed at a position inserted as far as to an upper portion of the main intake 810*a* but flush with the mating surface between the grill member 1300 and the main body 800. Thus, a vertical width of the gill member 1300 is reduced as much, and then a vertical width of the grill member 1300 in the main body 800 is reduced.

When the vertical width of the grill member 1300 in the main body 800 is shortened as described above, a distance between the grill member 1300 and the swirler 1010 may be increased by the shortened vertical width. As a result, a possibility of interference between the grill member 1300 and the swirler 1010 is reduced, thereby improving a safety of the apparatus.

Further, when the vertical width of the grill member 1300 in the main body 800 is shortened as described above, a space for installing other parts or apparatuses within the main body 800 is defined may be further secured in the main body 800. When there is no need to install other parts or apparatuses in the main body 800, a vertical width of the main body 800, particularly of the lower housing 810 may be reduced as much, thereby providing a slimmer ventilation apparatus 80.

Further, the grill member 1300 having a structure in which the inner section 1311 and the outer section 1315 are connected to each other by the first connection portion 1313 in the stepwise manner, and the outer section 1315 and the outer frame member 1330 are connected to each other by the second connection portion 1317 in the stepwise manner is formed in a form of a concavo-convex structure instead of a flat plate shape. Therefore, the grill member 1300 has a higher rigidity than the flat plate shaped structure, and thus has a high durability and a low possibility of flexural deformation or breakage.

Further, the grill member 1300 in the present embodiment may further include a protrusion 1325 for allowing the filter 1200 to be detachably installed on the grill member 1300.

The protrusion 1325 protrudes from the concentric member 1320. Further, the protrusion 1325 protrudes from the rib of the concentric member 1320 connected to the outer section 1315 toward the lateral center of the radial member 1310 to support the filter 1200 thereon.

This protrusion 1325 includes a plurality of protrusions spaced apart from each other along a circumferential direction of the rib of the concentric member 1320 formed in the circular ring shape. The filter 1200 received in the plurality of protrusions 1325 thus arranged may be stably supported by the plurality of protrusions 1325 while in a state of being inserted into the filter mounting space defined below the inner section 1311 and surrounded by the inner section 1311 and the first connection portion 1313.

The installation of the filter 1200 on the grill member 1300 may be accomplished as follows.

First, as shown in FIG. 29, the filter 1200 is inserted from a location below the grill member 1300 through an open bottom of the filter mounting space into the filter mounting space.

According to the present embodiment, the grill member 1300 may be divided into a first region and a second region. The first region is defined as a region positioned inside the grill member 1300 along the radial direction of the main air intake 810*a*. In addition, the second region is defined as a region positioned outwardly of the first region, i.e., a region positioned at a rim side of the main air intake 810*a*.

The first region is a region including the inner section 1311 therein and corresponds to a region of a central circle shape including the central portion of the grill member 1300 therein when the grill member 1300 is formed in the disc shape.

Further, the second region is a region including the outer section 1315 therein and corresponds to a rim region of the grill member 1300, that is, a region disposed at the outer side of the first region when the grill member 1300 is formed in a disc shape.

That is, the grill member 1300 includes the inner first region and the outer second region arranged concentrically. In this connection, the first connection portion 1313 defines a boundary between the first region and the second region.

Then, the first region may act as the suction passage, and the second region may act as the discharge passage.

According to this, the filter mounting space means a space defined below the inner section 1311 and surrounded by the inner section 1311 and the first connection portion 1313, that is, a space surrounded by the first region, which is a region positioned at the inner section of the grill member 1300.

In the present embodiment, the filter 1200 is illustrated as being formed in a shape and a size corresponding to a shape and a size of a horizontal plane of the filter mounting space. Thus, when the filter 1200 is bent upwardly when inserting the filter 1200 into the filter mounting space, the filter 1200 may easily pass through a lower entry portion of the filter mounting space, that is, a portion where the protrusion 1325 protrudes, so that the insertion of the filter 1200 may be more smoothly performed.

When an operator releases the filter 1200 while the filter 1200 is inserted into the filter mounting space such that a rim portion of the filter 1200 is positioned above the protrusion 1325, the filter 1200 made of a flexible material is returned to the shape of the circular plate, as shown in FIG. 30.

The filter 1200 thus returned to the previous shape is received on the plurality of protrusions 1325 in the filter 1200 mounting space. Therefore, the filter 1200 may be detachably installed in the grill member 1300 in a form stably supported by the plurality of protrusions 1325 in the filter mounting space.

In order to separate the filter 1200 thus installed from the grill member 1300, the operator needs to pull the filter 1200 downwardly while grasping the filter 1200 installed in the grill member 1300 and bending the filter 1200 upwardly. That is, the installation and replacement of the filter 1200 may be easily and quickly performed by a simple and easy operation of grasping, by the operator, the filter 1200 and fitting the filter 1200 upwardly or extracting filter 1200 downwardly.

Further, the protrusion 1325 disposed at the lower entry portion of the filter mounting space may be formed to protrude and extend in a rounded shape. In the present embodiment, the protrusion 1325 is illustrated as being protruding and extending in a semicircular shape.

When the protrusion 1325 is formed in the rounded shape as described above, the filter 1200 may be smoothly fitted or extracted along a rounded rim of the protrusion 1325 in a process of inserting the filter 1200 into the grill member 1300 or extracting the filter 1200 from the grill member 1300. In this process, the filter 1200 may be prevented from being scratched by the protrusion 1325 and broken.

Next, a flow of the airflow associated with that the grill member 1300 is divided into the first region and second region will be described.

As described above, the grill member 1300 may be divided into the first region containing the inner section 1311 therein and the second region containing the outer section 1315 therein. In addition, the filter 1200 is mounted in the first region containing the central portion of the grill member 1300. Further, the second region, which is an outer region of the grill member 1300 in a radial direction, corresponds to a region in which the filter 1200 is not mounted.

Further, the main air intake 810*a* on which such grill member 1300 is installed becomes to be in a state in which a predetermined region containing the central portion thereof is covered by the inner section 1311 and the filter 1200 disposed in the first region of the gill member 1300 and the peripheral rim region thereof is covered by the second region of the grill member 1300, that is, the peripheral rim region thereof is covered only by the outer section 1315 of the grill member 1300 without the filter 1200.

According to the present embodiment, the suction of the air by the operation of the blower 900 and the discharge of the vortex by the operation of the vortex forming apparatus 1000 are all performed through the main air intake 810*a*.

When the operation of the blower 900 and the operation of the vortex forming apparatus 1000 are simultaneously performed, the suction of the air by the operation of the blower 900 is mainly performed in a central region of the main air intake 810*a* and the vortex discharge by the operation of the vortex forming apparatus 1000 is mainly performed in the rim region of the main air intake 810*a*.

Considering this, in the present embodiment, the first region of the grill member 1300 in which the filter 1200 is mounted is disposed in the central region of the main air intake 810*a*, that is, in the region where the air is suctioned by the operation of the blower 900 and the second region of the grill member 1300 in which the filter 1200 is not mounted is disposed in the rim region of the main air intake 810*a*, that is, in the region where the vortex is discharged by the operation of the vortex forming apparatus 1000.

When the filter 1200 is mounted as far as to the second region disposed in the region where the vortex is discharged by the operation of the vortex forming apparatus 1000, not only the filtering of the air suctioned into the ventilation apparatus 80 is not performed well in the outer section 1315 but also the flow of the vortex generated by the operation of the vortex forming apparatus 1000 is not properly discharged below the main air intake 810*a* because of the filter 1200.

In contrast, in the present embodiment, the shape of the grill member 1300 is determined such that the outer region is disposed in the rim region of the main air intake 810*a* where the discharge of the vortex is mainly performed.

Preferably, a boundary between the first region and the second region of the grill member 1300 may be determined such that the second region of the grill member 1300 in which the outer section 1315 is formed is positioned below the blade portion 1015 of the swirler 1010. More particularly, the boundary between the first region and the second region of the grill member 1300 may be determined such that the second region of the grill member 1300 in which the outer section 1315 is formed is disposed on a path through which the vortex formed by the operation of the vortex forming apparatus 1000 passes the grill member 1300.

Thus, the ventilation apparatus 80 of the present embodiment may allow both the suction of the air by the operation of the blower 900 and the vortex formation by the operation of the vortex forming apparatus 1000 to be effectively performed even when the grill member 1300 and the filter 1200 are mounted thereto.

The description of the grill member 1300 and the filter of the present embodiment may be applied equally to the ventilation apparatus provided in the cooking apparatus of FIG. 1.

Although the present disclosure has been described with reference to exemplary embodiments illustrated in the drawings, the present disclosure is not limited thereto, but may be variously modified and altered by those skilled in the art to which the present disclosure pertains. Thus, the scope of the present disclosure should be construed on the basis of the accompanying claims.

The invention claimed is:

1. A ventilation apparatus comprising:

a case having a flow hole defined therein;

a flow guide positioned within the case, wherein the flow guide includes an inlet communicating with the flow hole and a guide surface inclined downwardly and outwardly;

a swirler positioned in a region defined by the flow guide and configured to rotate to discharge a portion of air inflowed through the flow hole out of the case, the swirler comprising a plurality of blades;

a driving motor configured to rotate the swirler; and a grill member that covers the swirler from an outside of the case and that defines an air flow path; and a filter detachably disposed at the grill member, wherein the grill member includes:

a first grill member that defines a suction passage, the filter being disposed at a lower portion of the first grill member, a second grill member that is disposed outside of the first grill member and that defines a discharge passage configured to discharge air suctioned through the suction passage, the second grill member being positioned lower than the first grill member, and a first connection part that connects the first grill member to the second grill member.

2. The ventilation apparatus of claim 1, wherein the first grill member comprises:

first radial ribs that extend in a radial direction; and first rounded ribs arranged concentrically and connected to the first radial ribs.

3. The ventilation apparatus of claim 2, wherein the second grill member comprises:

second radial ribs that extend in the radial direction; and second rounded ribs arranged concentrically and connected to the second radial ribs.

4. The ventilation apparatus of claim 3, wherein a length of at least one of the first radial ribs is greater than a length of at least one of the second radial ribs.

5. The ventilation apparatus of claim 3, wherein the second grill member further includes a protrusion that protrudes from the second grill member to support the filter.

6. The ventilation apparatus of claim 5, wherein the protrusion includes a plurality of protrusions that are spaced apart from one another by a predetermined interval along a circumferential direction of one of the second rounded ribs.

7. The ventilation apparatus of claim 5, wherein the protrusion has a round shape.

8. The ventilation apparatus of claim 1, wherein the grill member further comprises:

an outer frame disposed outside of the second grill member, the outer frame being disposed higher than the second grill member; and a second connection portion that connects the outer frame to the second grill member.

9. The ventilation apparatus of claim 8, wherein the outer frame and the second connection portion are flush with each other.

10. The ventilation apparatus of claim 8, wherein the outer frame has a circular ring shape, and wherein the outer frame defines a plurality of fastening holes for fastening the case and the outer frame, the plurality of fastening holes being spaced apart from one another along a circumferential direction of the outer frame.

11. The ventilation apparatus of claim 10, wherein the outer frame further defines an alignment cut at an outer rim of the outer frame, and wherein the alignment cut is configured to engage with an alignment structure of the case and to guide an installation position of the grill member such that the plurality of fastening holes are aligned with predetermined positions of the case, respectively.

12. The ventilation apparatus of claim 1, wherein the filter extends to a radial end of the first grill member, and the second grill member is exposed to the outside of the case.

13. The ventilation apparatus of claim 1, wherein the first grill member is recessed upward relative to the second grill member and defines a filter mounting space configured to accommodate the filter therein.

14. The ventilation apparatus of claim 13, wherein the second grill member comprises a plurality of protrusions that are spaced apart from one another along a circumferential direction and that protrudes radially inward to the filter mounting space.

* * * * *